US005328817A

United States Patent [19]

Nakagawa et al.

[11] Patent Number: 5,328,817

[45] Date of Patent: * Jul. 12, 1994

[54] SILVER HALIDE COLOR PHOTOGRAPHIC MATERIAL

[75] Inventors: Hajime Nakagawa; Yasuhiro Yoshioka, both of Minami-ashigara, Japan

[73] Assignee: Fuji Photo Film Co., Ltd., Kanagawa, Japan

[ * ] Notice: The portion of the term of this patent subsequent to Mar. 12, 2010 has been disclaimed.

[21] Appl. No.: 870,928

[22] Filed: Apr. 20, 1992

[30] Foreign Application Priority Data

Apr. 20, 1991 [JP] Japan ..... 3-116892

[51] Int. Cl.[5] ..... G03C 1/46

[52] U.S. Cl. ..... 430/503; 430/553; 430/557

[58] Field of Search ..... 430/503, 553, 557

[56] References Cited

U.S. PATENT DOCUMENTS

| | | | |
|---|---|---|---|
| 2,369,929 | 2/1945 | Vittum et al. . | |
| 4,149,886 | 4/1979 | Tanaka et al. | 430/557 |
| 4,248,961 | 2/1981 | Hagen et al. | 430/557 |
| 4,621,047 | 11/1986 | Kishimoto et al. . | |
| 5,070,003 | 12/1991 | Naruse et al. | 430/557 |
| 5,084,375 | 1/1992 | Umemoto et al. | 430/505 |
| 5,194,369 | 3/1993 | Mihayashi et al. | 430/557 |
| 5,213,958 | 5/1993 | Motoki et al. | 430/557 |

FOREIGN PATENT DOCUMENTS

| | | |
|---|---|---|
| 320939 | 6/1989 | European Pat. Off. . |
| 447920A1 | 3/1991 | European Pat. Off. . |
| 1204680 | 9/1970 | United Kingdom . |

*Primary Examiner*—Charles L. Bowers, Jr.
*Assistant Examiner*—Geraldine Letscher
*Attorney, Agent, or Firm*—Birch, Stewart, Kolasch & Birch

[57] ABSTRACT

There is disclosed a silver halide color photographic material which comprises at least one yellow coupler represented by the following formulas (1) or (2), and at least one cyan coupler represented by the following formula (C):

Formula (1)

Formula (2)

wherein $X^1$ and $X^2$ each represent an alkyl group, an aryl group, or a heterocyclic group, $X^3$ represents an organic residue required to form a nitrogen-containing heterocyclic group together with >N—, Y represents an aryl group or a heterocyclic group, and Z represents a group capable of being released upon a coupling reaction of the coupler represented by said formula with the oxidized product of a developing agent, Formula (C)

wherein $R_1$ represents an alkyl group, an aryl group, or a heterocyclyc group, $R_2$ represents an alkyl group having 2 or more carbon atoms, $R_3$ represents a hydrogen atom, a halogen atom, an alkyl group, an aryl group, an alkoxy group, an aryloxy group, a carbonamido group, or a ureido group, X represents a hydrogen atom or a coupling split-off group, and n is an integer of 0 or 1.

18 Claims, No Drawings

SILVER HALIDE COLOR PHOTOGRAPHIC MATERIAL

FIELD OF THE INVENTION

The present invention relates to a silver halide color photographic material, and more particularly to a silver halide color photographic material improved in the problem of insufficiency of color formation of the cyan coupler and improved in preservability of the color image obtained by processing it.

BACKGROUND OF THE INVENTION

Silver halide color photographic materials are exposed to light imagewise and are developed with an aromatic amine color-developing agent, and the resulting oxidized product of the developing agent and dye image-forming couplers (hereinafter abbreviated as couplers) interact to form dye images. Generally, in a color photographic material, a combination of a yellow coupler, a cyan coupler, and a magenta coupler is used.

In this method, generally, as a cyan coupler, a phenol or naphthol cyan coupler; as a magenta coupler, a 5-pyrazolone or pyrazolotriazole coupler; and as a yellow coupler, an acylacetamide yellow coupler are used.

The performance required for these couplers generally includes, for example, that they undergo coupling reactions quickly with the oxidized product of a color-developing agent, such as a p-phenylenediamine derivative in a color developer, whose coupling speed is high enough to be able to form dyes; that they can form dyes having satisfactory densities immediately after being processed; and that the storage stability of the color images obtained by processing them is good. However, it is very difficult to select couplers that can satisfy all of these requirements, and a photographic material is required wherein the balance among the color-forming couplers of three colors, that is, yellow, magenta, and cyan, is good to satisfy the above requirements.

In particular, in the case of cyan couplers, a decrease in the concentration of the cyan color-formed dye due to the leuco-dye formation (insufficiency of cyan color formation) is liable to occur in a bleaching solution or a bleach-fix solution in which the oxidizing agent has been fatigued or in which a reducing agent (e.g., a color-developing agent) carried in by the photographic material has accumulated, and its improvement is desired.

In the case of color photographic materials for prints, in many cases color prints are stored for a long period of time in an album and, although the time the prints are exposed to light is short, when they are stored in a dark place high in temperature and humidity for a long period of time, fading is a problem in many cases. With respect to heat-fading in darkness, magenta is the highest in fastness, and yellow and then cyan are liable to fade. Therefore, when color prints are stored for a long period of time, the color balance among the three colors is disadvantageously lost.

To improve insufficiency of cyan color formation, 2-acylaminophenol cyan couplers are described, for example, in JP-A ("JP-A" means unexamined published Japanese patent application) No. 117249/1985, and 2,5-diacylaminophenol cyan couplers are described, for example, in U.S. Pat. No. 2,895,826; and these have an effect to a certain extent. Further, combinations of 2,5-diacylaminophenol cyan couplers with novel cyan couplers are described, for example, in U.S. Pat. No. 4,770,988.

Further, as a technique for improving the preservability of color images, a method for improving the color balance by a combination of a specific magenta coupler with a specific cyan coupler is described in JP-A No. 73260/1987, and combinations of specific yellow, magenta, and cyan couplers are described, for example, in U.S. Pat. No. 4,748,100.

Any of the above techniques shows an improving effect to some extent, but none of them bring about improvement wherein loss of color balance due to insufficiency of color formation of cyan couplers and due to fading of color images obtained by processing is completely obviated.

Moreover, recently, in order to meet the clients' demands or to preserve the natural environment, so-called rapid processing, wherein the development time is short; development processing which is substantially free from benzyl alcohol; processing wherein the amount of water is small or no water is used; and processing with a processing solution wherein the ratio of and the amounts of components are drastically changed in the running test state, are performed. In such processing, particularly, it is required to prevent the occurrence of insufficiency of color formation of cyan couplers and to improve preservability of the color image obtained by the processing.

SUMMARY OF THE INVENTION

The object of the present invention is to provide a silver halide color photographic material wherein the cyan coupler is prevented from becoming insufficient in color formation and the color balance among the yellow, magenta, and cyan color images obtained by processing it is hardly lost, so that the preservability of the color images is improved.

Other and further objects, features, and advantages of the invention will appear more fully from the following description.

DETAILED DESCRIPTION OF THE INVENTION

The inventors have found that the problem of insufficiency of color formation of cyan couplers depends not only on the type of cyan coupler itself but also on the type of the yellow coupler in another layer, particularly in the lowermost layer in the case of color paper. The inventors have found that a combination of a yellow coupler having a certain novel structure with a specific cyan coupler improves remarkably the problem of insufficiency of color formation. Further, the inventors also have found that fastness of cyan and yellow color images is made better remarkably and that the color balance among three colors, that is, yellow, magenta, and cyan, during long-term storage is improved.

The object of the present invention has been attained by the following photographic material:

A silver halide color photographic material having on a base at least one cyan color-forming silver halide emulsion layer, at least one magenta color-forming silver halide emulsion layer, and at least one yellow color-forming silver halide emulsion layer, which comprises, in said yellow color forming silver halide emulsion layer, at least one yellow coupler represented by the following formula (1) or (2), and, in said cyan color forming silver halide emulsion layer, at least one cyan coupler represented by the following formula (C):

Formula (1)

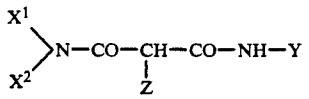

Formula (2)

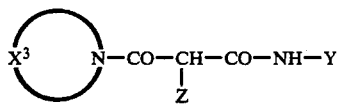

wherein $X^1$ and $X^2$ each represent an alkyl group, an aryl group, or a heterocyclic group, $X^3$ represents an organic residue required to form a nitrogen-containing heterocyclic group together with >N—, Y represents an aryl group or a heterocyclic group, and Z represents a group capable of being released upon a coupling reaction of the coupler represented by said formula with the oxidized product of a developing agent (hereinafter referred to as a coupling split-off group)

Formula (C)

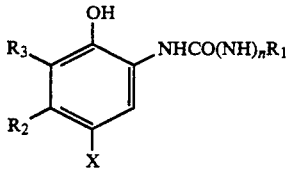

wherein $R_1$ represents an alkyl group, an aryl group, or a heterocyclic group, $R_2$ represents an alkyl group having 2 or more carbon atoms, $R_3$ represents a hydrogen atom, a halogen atom, an alkyl group, an aryl group, an alkoxy group, an aryloxy group, a carbonamido group, or a ureido group, X represents a hydrogen atom or a coupling split-off group, and n is an integer of 0 or 1.

Couplers represented by formula (1) and (2) will be described in detail.

In formula (1) or (2), when $X^1$ and $X^2$ represent an alkyl group, the alkyl group is a straight-chain, branched chain, or cyclic, saturated or unsaturated, substituted or unsubstituted alkyl group having a carbon number (hereinafter abbreviated to a C-number) of 1 to 30, preferably 1 to 20. Examples of the alkyl group are methyl, ethyl, propyl, butyl, cyclopropyl, allyl, t-octyl, i-butyl, dodecyl, and 2-hexyldecyl.

When $X^1$ and $X^2$ represent a heterocyclic group, the heterocyclic group is a 3- to 12-membered, preferably a 5- to 6-membered, saturated or unsaturated, substituted or unsubstituted, monocyclic or condensed ring heterocyclic group having a C-number of 1 to 20, preferably 1 to 10, and at least one heteroatom, such as a nitrogen atom, an oxygen atom, or a sulfur atom. As an example of the heterocyclic group, 3-pyrrolidinyl, 1,2,4-triazole-3-yl, 2-pyridyl, 4-prymidinyl, 3-pyrazolyl, 2-pyrrolyl, 2,4-dioxo-1,3-imidazolidine-5-yl, or pyranyl can be mentioned.

When $X^1$ and $X^2$ represent an aryl group, the aryl group is a substituted or unsubstituted aryl group having a C-number of 6 to 20, preferably 6 to 10. As a typical example of the aryl group, a phenyl group and a naphthyl group can be mentioned.

When $X^3$ represents a nitrogen-containing heterocyclic group together with >N—, the heterocyclic group is a 3- to 12-membered, preferably 5- to 6-membered, substituted or unsubstituted, saturated or unsaturated, monocyclic or condensed ring heterocyclic group that have a C-number of 1 to 20, preferably 1 to 15 and may contain in addition to the nitrogen atom, for example, an oxygen atom or a sulfur atom as heteroatom. As an example of the heterocyclic group, pyrrolidino, piperidino, morpholino, 1-piperazinyl, 1-indolinyl, 1,2,3,4-tetrahydroquinoline-1-yl, 1-imidazolidinyl, 1-pyrazolyl, 1-pyrrolinyl, 1-pyrazolidinyl, 2,3-dihydro-1-indazolyl, 2-isoindolinyl, 1-indolyl, 1-pyrrolyl, 4-thiazine-S,S-dioxo-4-yl or benzoxadine-4-yl can be mentioned.

When $X^1$ and $X^2$ represent a substituted alkyl, aryl or heterocyclic group and $X^3$ represents a substituted nitrogen-containing heterocyclic group together with >N—, examples of the substituent include: a halogen atom (e.g., fluorine and chlorine), an alkoxycarbonyl group (preferably having a C-number of 2 to 30, and more preferably 2 to 20, e.g., methoxycarbonyl, dodecyloxycarbonyl, and hexadecyloxycarbonyl), an acylamino group (preferably having a C-number of 2 to 30, and more preferably 2 to 20, e.g., acetamido, tetradecaneamido, 2-(2,4-di-t-amylphenoxy)butaneamido, and benzamido), a sulfonamido group (preferably having a C-number of 1 to 30, and more preferably 1 to 20, e.g., methanesulfonamido, dodecanesulfonamido, hexadecylsulfonamido, and benzenesulfonamido), a carbamoyl group (preferably having a C-number of 1 to 30, and more preferably 1 to 20, e.g., N-butylcarbamoyl and N,N-diethylcarbamoyl), an N-sulfonylcarbamoyl group (preferably having a C-number of 1 to 30, and more preferably 1 to 20, e.g., N-mesylcarbamoyl and N-dodecylsulfonylcarbamoyl), a sulfamoyl group (preferably having a C-number of 1 to 30, and more preferably 1 to 20, e.g., N-butylsulfamoyl, N-dodecylsulfamoyl, N-hexadecylsulfamoyl, N-3-(2,4-di-t-amylphenoxy)butylsulfamoyl, and N,N-diethylsulfamoyl), an alkoxy group (preferably having a C-number of 1 to 30, and more preferably 1 to 20, e.g., methoxy, hexadecyloxy, and isopropoxy), an aryloxy group (preferably having a C-number of 6 to 20, and more preferably 6 to 10, e.g., phenoxy, 4-methoxyphenoxy, 3-t-butyl--hydroxyphenxy, and naphthoxy), an aryloxycarbonyl group (preferably having a C-number of 7 to 21, and more preferably 7 to 11, e.g., phenoxycarbonyl), an N-acyl-sulfamoyl group (preferably having a C-number of 2 to 30, and more preferably 2 to 20, e.g., N-propanoylsulfamyl and N-tetradecanoylsulfamyl), a sulfonyl group (preferably having a C-number of 1 to 30, and more preferably 1 to 20, e.g., methanesulfonyl, octanesulfonyl, 4-hydroxyphenylsulfonyl, and dodecanesulfonyl), an alkoxycarbonylamino group (preferably having a C-number of 1 to 30, and more preferably 1 to 20, e.g., ethoxycarbonylamino), a cyano group, a nitro group, a carboxyl group, a hydroxyl group, a sulfo group, an alkylthio group (preferably having a C-number of 1 to 30, and more preferably 1 to 20, e.g., methylthio, dodecylthio, and dodecylcarbamoylmethylthio), a ureido group (having a C-number of 1 to 30, more preferably 1 to 20, e.g., N-phenylureido and N-hexadecylureido), an aryl group (preferably having a C-number of 6 to 20, and more preferably 6 to 10, e.g., phenyl, naphthyl, and 4-methoxyphenyl), a heterocyclic group (which is a 3- to 12-membered, preferably 5- to 6-membered, monocyclic or condensed ring having preferably a C-number of 1 to 20, and more preferably 1 to 10 and containing at least one heteroatom, such as a nitrogen atom, an oxygen atom, and a sulfur atom, e.g., 2-pyridyl, 3-pyrazolyl, 1-pyrrolyl, 2,4-dioxo-1,3-imidazolidine-1-yl, 2-benzoxazolyl, morpholino, and indolyl), an alkyl group (which may be straight-chain, branched chain, or cyclic and saturated or unsaturated and preferably has a C-number of 1 to 30, and more preferably 1 to 20, e.g., methyl, ethyl, isopropyl, cyclopropyl, t-pentyl, t-octyl, cyclopentyl, t-butyl, s-butyl, dodecyl, and 2-hexyldecyl), an acyl group (preferably having a C-number of 1 to 30, and more preferably 2 to 20, e.g., acetyl and benzoyl), an acyloxy group (preferably having a C-number of 2 to 30, and more preferably 2 to 20, e.g., propanoyloxy and tetradecanoyloxy), an arylthio group (preferably having a C-number of 6 to 20, and more preferably 6 to 10, e.g., phenylthio and naphthylthio), a sulfamoylamino group (preferably having a C-number of 0 to 30, and more preferably 0 to 20, e.g., N-butylsulfamoylamino, N-dodecylsulfamoylamino, and N-phenylsulfamoylamino), or an N-sulfonylsulfamoyl group (preferably having a C-number of 1 to 30, and more preferably 1 to 20, e.g., N-methylsulfamoyl, N-ethanesulfonylsulfamoyl, N-dodecanesulfonylsulfamoyl, and N-hexadecanesulfonylsulfamoyl). These substituents may be further substituted. Examples of the substituent include those mentioned above.

Among the above substituents, preferable ones includes, for example, an alkoxy group, a halogen atom, an alkoxycarbonyl group, an acyloxy group, an acylamino group, a sulfonyl group, a carbamoyl group, a sulfamoyl group, a sulfonamido group, a nitro group, an alkyl group, or an aryl group.

When Y in formulas (1) and (2) represents an aryl group, the aryl group is a substituted or unsubstituted aryl group preferably having a C-number of 6 to 20, and more preferably 6 to 10. Typical examples thereof are a phenyl group and a naphthyl group.

When Y in formulas (1) and (2) represents a heterocyclic group, the heterocyclic group has the same meaning as that of the heterocyclic group represented by $X^1$ and $X^2$.

When Y represents a substituted aryl group or a substituted heterocyclic group, examples of the substituent include those mentioned as examples of the substituent possessed by $X^1$. Preferable examples of the substituted aryl group and heterocyclic group represented by Y are those wherein the substituted group has a halogen atom, an alkoxycarbonyl group, a sulfamoyl group, a phenoxy group, a carbonamido group, a carbamoyl group, a sulfonyl group, an N-sulfonylsulfamoyl group, an N-acylsulfamoyl group, an alkoxy group, an acylamino group, an N-sulfonylcarbamoyl group, a sulfonamido group, or an alkyl group.

A particularly preferable example of Y is a phenyl group having at least one substituent in the ortho position.

The group represented by Z in formulas (1) and (2) may be any one of the conventionally known groups capable of being released upon a coupling reaction (which is referred to as coupling split-off groups). Preferably, Z includes, for example, a nitrogen-containing heterocyclic group bonded to the coupling site through the nitrogen atom, an aryloxy group, an arylthio group, a heterocyclic oxy group, a heterocyclic thio group, an acyloxy group, a carbamoyloxy group, an alkylthio group, or a halogen atom.

These coupling split-off groups may be any one of the nonphotographically useful groups, photographically useful groups, or precursors therefor (e.g., a development retarder, a development accelerator, a desilvering accelerator, a fogging agent, a dye, a hardener, a coupler, a developing agent oxidized product scavenger, a fluorescent dye, a developing agent, or an electron transfer agent).

When Z is a photographically useful group, one which is conventionally known is useful. For example, photographically useful groups described, for example, in U.S. Pat. No. 4,248,962, 4,409,323, 4,438,193, 4,421,845, 4,618,571, 4,652,516, 4,861,701, 4,782,012, 4,857,440, 4,847,185, 4,477,563, 4,438,193, 4,628,024, 4,618,571, or 4,741,994, and Europe Publication Patent No. 193,389A, 348,139A, or 272,573A or coupling split-off groups for releasing them (e.g., a timing group) are used.

When Z represents a nitrogen-containing heterocyclic group bonded to the coupling site through the nitrogen atom, preferably Z represents a 5- to 6-membered, substituted or unsubstituted, saturated or unsaturated, monocyclic or condensed ring heterocyclic group preferably having a C-number of 1 to 15, and more preferably 1 to 10. As a heteroatom, in addition to the nitrogen atom, an oxygen atom or a sulfur atom may be present. As a preferable example of the heterocyclic group, 1-pyrazolyl, 1-imidazolyl, pyrrolino, 1,2,4-triazole-2-yl, 1,2,3-triazole-1-yl, benzotriazolyl, benzimidazolyl, imidazolidine-2,4-dione-3-yl, oxazolidine-2,4-dione-3-yl, 1,2,4-triazolidine-3,5-dione-4-yl, imidazolidine-2,4,5-trion-3-yl, 2-imidazolinone-1-yl-, 3,5-dioxomorpholino, or 1-indazolyl can be mentioned. When these heterocyclic groups are substituted, the substituent includes those mentioned as examples of the substituent which may be possessed by the $X^1$ group. Preferable substituents are those wherein one substituent is an alkyl group, an alkoxy group, a halogen atom, an alkoxycarbonyl group, an aryloxycarbonyl group, an alkylthio group, an acylamino group, a sulfonamido group, an aryl group, a nitro group, a carbamoyl group, or a sulfonyl group.

When Z represents an aromatic oxy group, preferably the aromatic oxy group is a substituted or unsubstituted aromatic oxy group having a C-number of 6 to 10, and more preferably a substituted or unsubstituted phenoxy group. If the aromatic oxy group is substituted, examples of the substituent include those mentioned as examples of the substituent which may be possessed by $X^1$ mentioned above. Among them, preferable substituents are those wherein at least one substituent is an electron-attractive substituent, such as a sulfonyl group, an alkoxycarbonyl group, a sulfamoyl group, a halogen atom, a carboxyl group, a carbamoyl group, a nitro group, a cyano group, or an acyl group.

When Z represents an aromatic thio group, preferably the aromatic thio group is a substituted or unsubstituted aromatic thio group having a C-number of 6 to 10, and more preferably a substituted or unsubstituted phenylthio group. When the aromatic thio group is substituted, examples of the substituent include those mentioned as examples of the substituent which may be possessed by $X^1$ mentioned above. Among them, preferable substituents are those wherein at least one substituent is an alkyl group, an alkoxy group, a sulfonyl group, an alkoxycarbonyl group, a sulfamoyl group, a halogen atom, a carbamoyl group, or a nitro group.

When Z represents a heterocyclic oxy group, preferably the heterocyclic moiety has 1 to 20 carbon atoms, and more preferably 1 to 10 carbon atoms and at least one heteroatom, for example, one nitrogen atom, one oxygen atom, or one sulfur atom and is 3- to 12-membered, more preferably 5- to 6-membered, substituted or unsubstituted, saturated or unsaturated, monocyclic or condensed ring, heterocyclic group. As an example of the heterocyclic oxy group, a pyridyloxy group, a pyrazolyloxy group, or a furyloxy group can be mentioned. When the heterocyclic oxy group is substituted, examples of the substituent include those mentioned as examples of the substituent which may be possessed by $X^1$ mentioned above. Among them, preferable substituents are those wherein at least one substituent is an alkyl group, an aryl group, a carboxyl group, an alkoxy group, a halogen atom, an alkoxycarbonyl group, an aryloxycarbonyl group, an alkylthio group, an acylamino group, a sulfonamido group, a nitro group, a carbamoyl group, or a sulfonyl group.

When Z represents a heterocyclic thio group, preferably the heterocyclic moiety has 1 to 20 carbon atoms, and more preferably 1 to 10 carbon atoms and at least one heteroatom, for example, one nitrogen atom, one oxygen atom, or one sulfur atom and is 3- to 12-membered, more preferably 5- to 6-membered, substituted or unsubstituted, saturated or unsaturated, monocyclic or condensed ring, heterocyclic group. As an example of the heterocyclic thio group, a tetrazolylthio group, a 1,3,4-thiadiazolylthio group, a 1,3,4-oxadiazolylthio group, a 1,3,4-triazolylthio group, a benzoimidazolylthio group, a benzothiazolylthio group, or a 2-pyridylthio group can be mentioned. When the heterocyclic thio group is substituted, examples of the substituent include those mentioned as examples of the substituent which may be possessed by $X^1$ mentioned above. Among them, preferable substituents are those wherein at least one substituent is an alkyl group, an aryl group, a carboxyl group, an alkoxy group, a halogen atom, an alkoxycarbonyl group, an aryloxycarbonyl group, an alkylthio group, an acylamino group, a sulfonamido group, a nitro group, a carbamoyl group, a heterocyclic group, or a sulfonyl group.

When Z represents an acyloxy group, the acyloxy group is a monocyclic or condensed ring, substituted or unsubstituted, aromatic acyloxy group preferably having 6 to 10 carbon atoms or a substituted or unsubstituted aliphatic acyloxy group preferably having 2 to 30 carbon atoms, and more preferably 2 to 20 carbon atoms. When the acyloxy group is substituted, examples of the substituent include those mentioned as examples of the substituent which may be possessed by $X^1$ mentioned above.

When Z represents a carbamoyloxy group, the carbamoyloxy group is an aliphatic or aromatic or heterocyclic, substituted or unsubstituted carbamoyloxy group preferably having a C-number of 1 to 30, and more preferably 1 to 20. As an example, N,N-diethylcarbamoyloxy, N-phenylcarbamoyloxy, 1-imidazolylcarbonyloxy, or 1-pyrrolocarbonyloxy can be mentioned. When the carbamoyloxy group is substituted, examples of the substituent include those mentioned as examples of the substituent which may be possessed by $X^1$ mentioned above.

When Z represents an alkylthio group, the alkylthio group is a substituted or unsubstituted, straight-chain, branched chain, or cyclic, saturated or unsaturated alkylthio group having a C-number of 1 to 30, more preferably 1 to 20. When the alkylthio group is substituted, examples of the substituent include those mentioned as examples of the substituent which may be possessed by $X^1$ mentioned above.

Now, couplers represented by formulas (1) and (2) that fall in a particularly preferable range will be described.

The group represented by $X^1$ in formula (1) is preferably an alkyl group, and particularly preferably an alkyl group having a C-number of 1 to 10.

The group represented by Y in formulas (1) and (2) is preferably an aromatic group, and particularly preferably a phenyl group having at least one substituent in the ortho position. The substituent includes those mentioned above, which may be possessed by the aromatic group represented by Y. Preferable substituents include preferable ones mentioned above, which may be possessed by the aromatic group represented Y.

The group represented by Z in formulas (1) and (2) includes preferably a 5- to 6-membered nitrogen-containing heterocyclic group bonded to the coupling site through the nitrogen atom, an aromatic oxy group, a 5- to 6-membered heterocyclic oxy group, or a 5- to 6-membered heterocyclic thio group.

Preferable couplers in formulas (1) and (2) are represented by the following formula (3), (4), or (5):

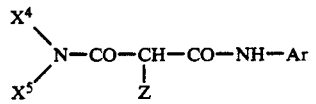

Formula (3)

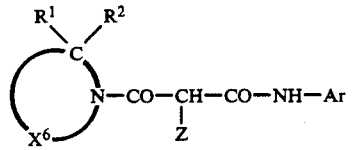

Formula (4)

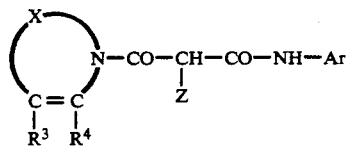

Formula (5)

wherein Z has the same meaning as defined in formula (1), $X^4$ represents an alkyl group, $X^5$ represents an alkyl group or an aromatic group, Ar represents a phenyl group having at least one substituent in the ortho position, $X^6$ represents an organic residue required to form a nitrogen-containing cyclic group (monocyclic or condensed ring) together with $—C(R^1R^2)—N<$, $X^7$ represents an organic residue required to form a nitrogen heterocyclic group (monocyclic or condensed ring) together with $—C(R^3)=C(R^4)—N<$, and $R^1$, $R^2$, $R^3$, and $R^4$ each represent a hydrogen atom or a substituent. As a substituent in the ortho position of Ar are included, in particularly preferably, for example, a chlorine atom, a fluorine atom, an alkyl group having a C-number of 1 to 6 (e.g., methyl, trifluoromethyl, ethyl, iso-propyl, and t-butyl), an alkoxy group having a C-number of 1 to 8 (e.g., methoxy, ethoxy, methoxyethoxy, and butoxy), and an aryloxy group having a C-number of 6 to 24 (e.g., phenoxy, p-tolyloxy, and p-methoxyphenoxy), with the most preferred a chlorine atom, methoxy, and trifluoromethyl group.

With respect to a detailed description and a preferable range of the groups represented by $X^4$ to $X^7$, Ar, and Z in formulas (3) to (5), the description in the relevant range described for formulas (1) and (2) is applied. When $R^1$ to $R^4$ represent a substituent, examples include those substituents that may be possessed by $X^1$ mentioned above.

Among the couplers represented by the above mentioned formulas, particularly preferable couplers are those represented by formula (4) or (5).

The couplers represented by formulas (1) to (5) may form a dimer or higher polymer (e.g., a telomer or a polymer) by bonding at the groups represented by $X^1$ to $X^7Y$, Ar, $R^1$ to $R^4$ and Z through a divalent group or higher polyvalent group. In that case, the number of carbon atoms may fall outside the range of the number of carbon atoms defined in the above-mentioned substituents.

Preferable examples of the couplers represented by formulas (1) to (5) are nondiffusible couplers. The term "nondiffusible couplers" refers to couplers having in the molecule a group with a molecular weight large enough to make the molecule immobilized in the layer in which the molecule is added. Generally an alkyl group having a C-number of 8 to 30, preferably 10 to 20, or an aryl group having a C-number of 4 to 40, is used. These nondiffusible groups may be substituted on any position in the molecule, and two or more of them may be present in the molecule.

Specific examples of the couplers represented by formulas (1) to (5) are shown below, but the present invention is not restricted to them.

Y-1

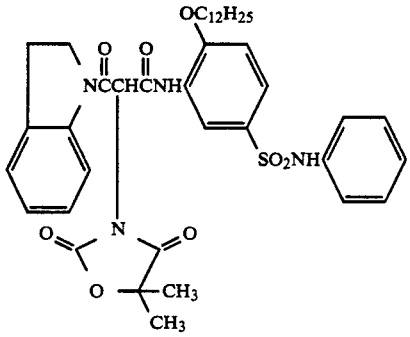

Y-2

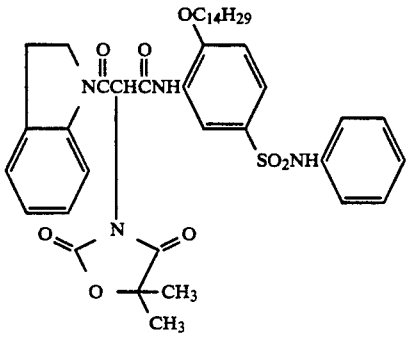

Y-3

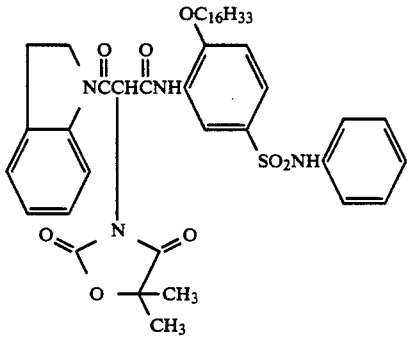

Y-4

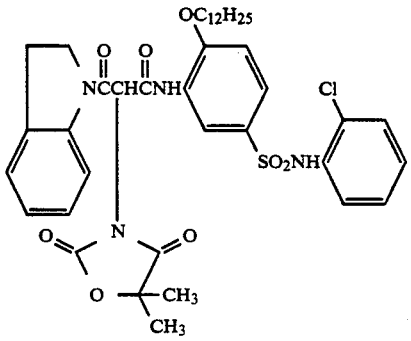

Y-5

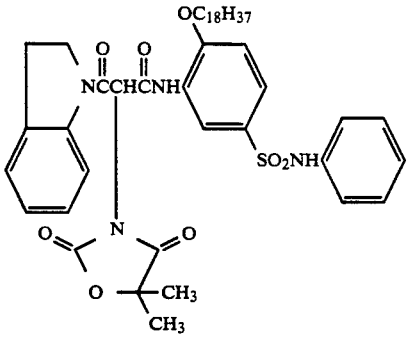

Y-6

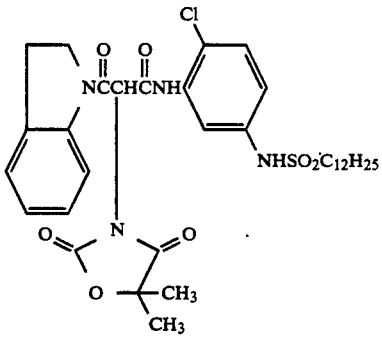

Y-7

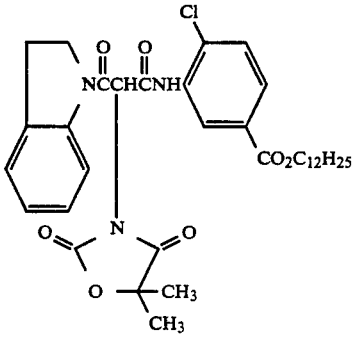

Y-8

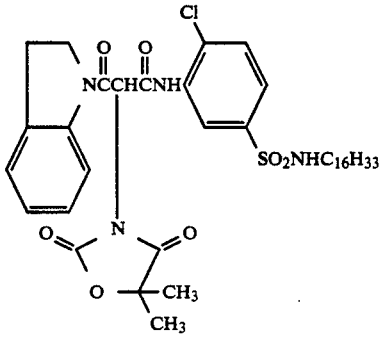

-continued
Y-9
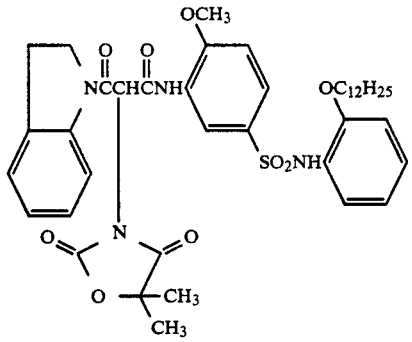
Y-10
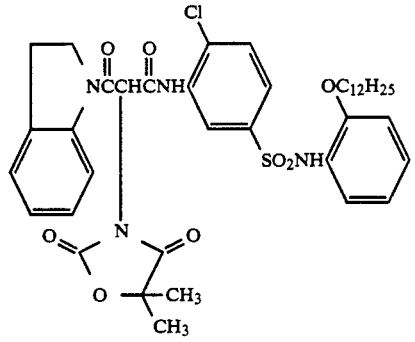
Y-11
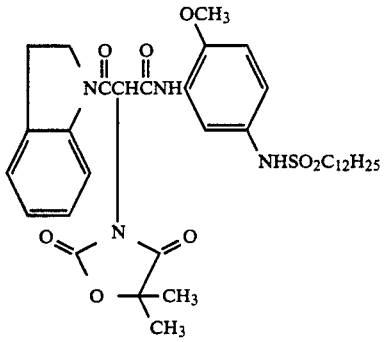
Y-12
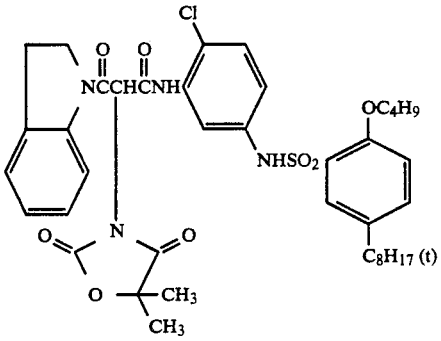
Y-13
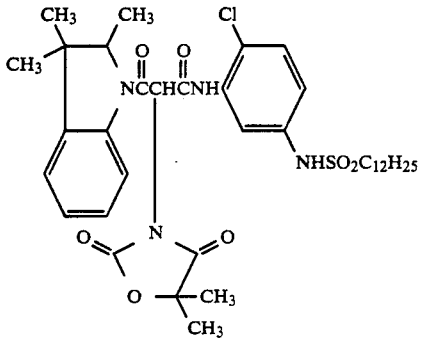
Y-14
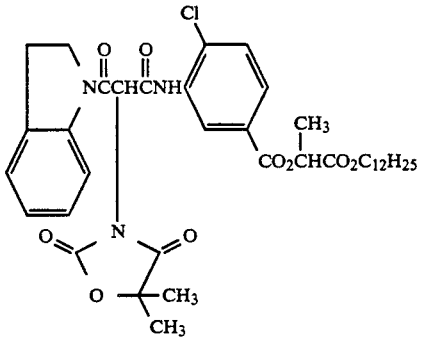
Y-15
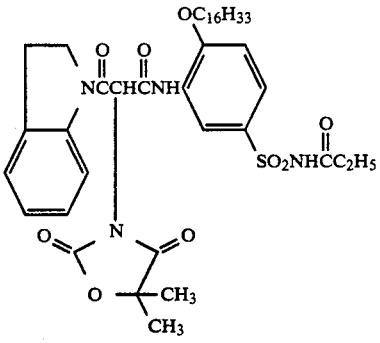
Y-16
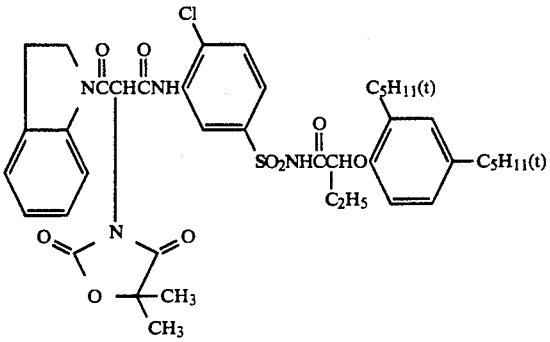

-continued
Y-17
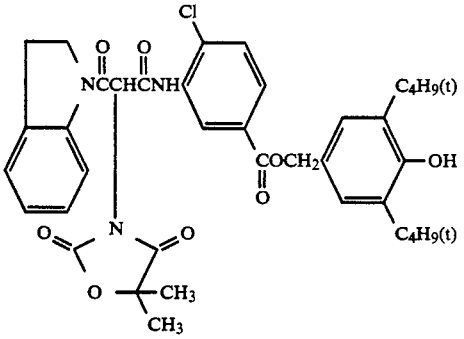
Y-18
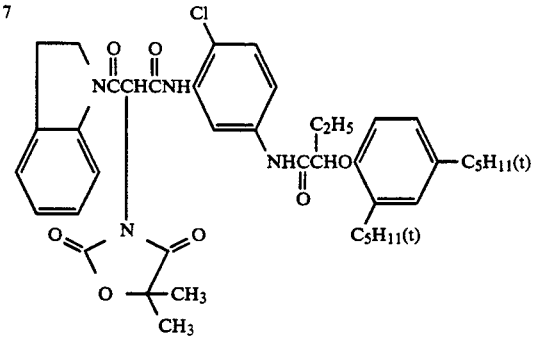
Y-19
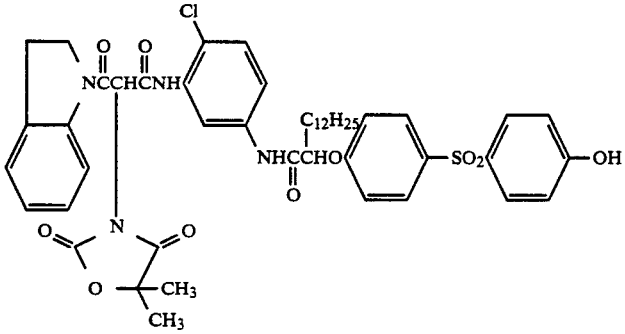
Y-20
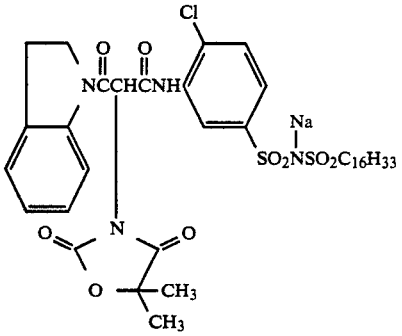
Y-21
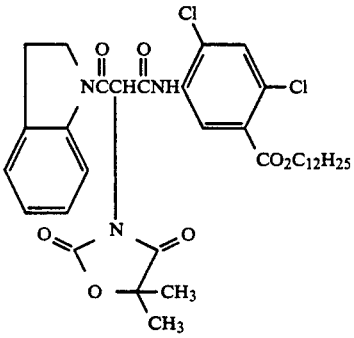
Y-22
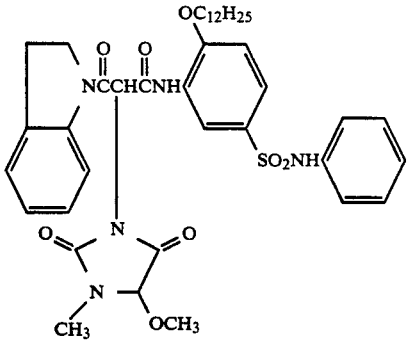
Y-23
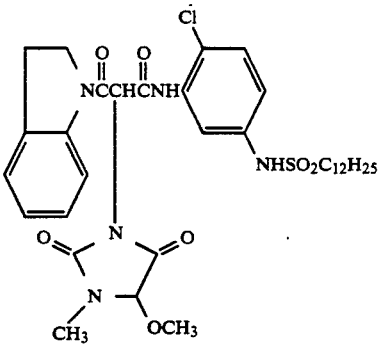
Y-24
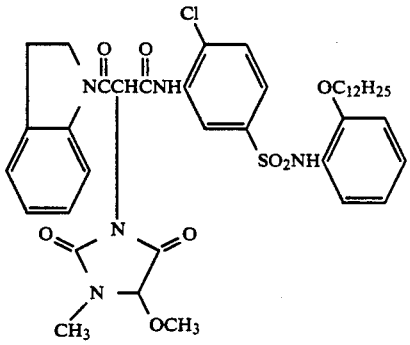
Y-25
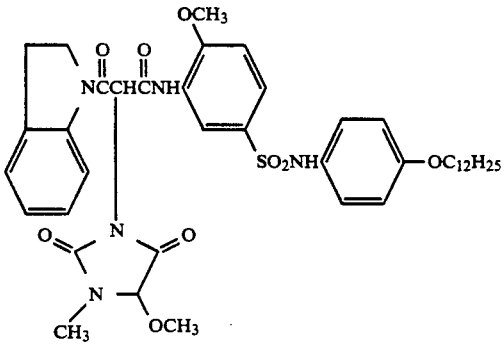

-continued
Y-26
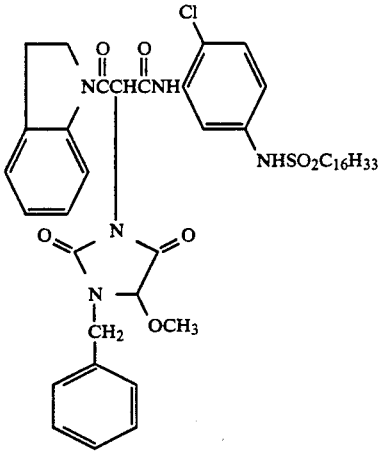
Y-27
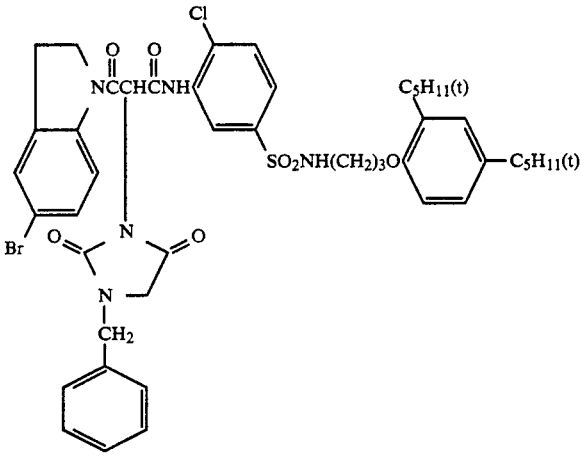
Y-28
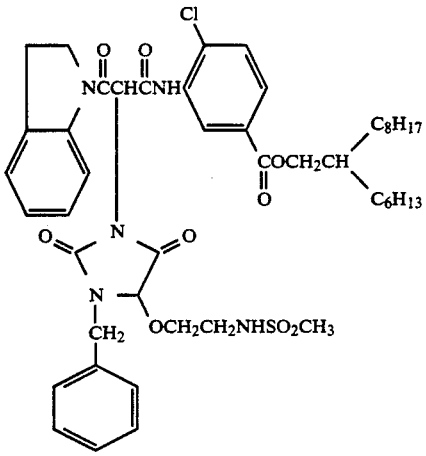
Y-29
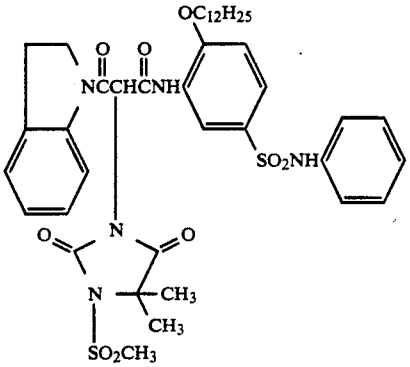

-continued
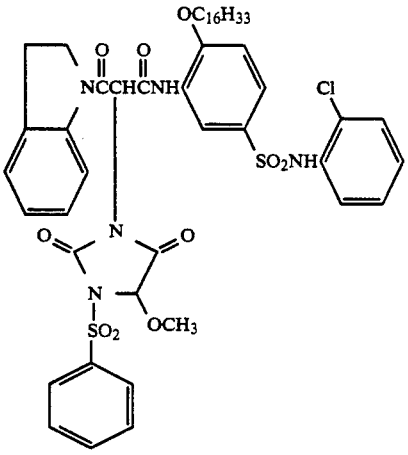
Y-30
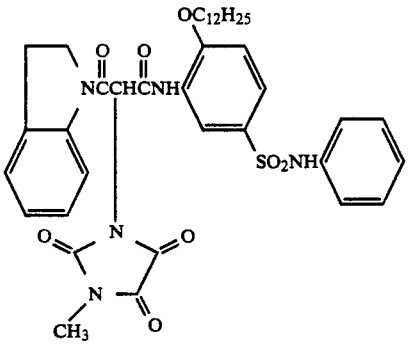
Y-31
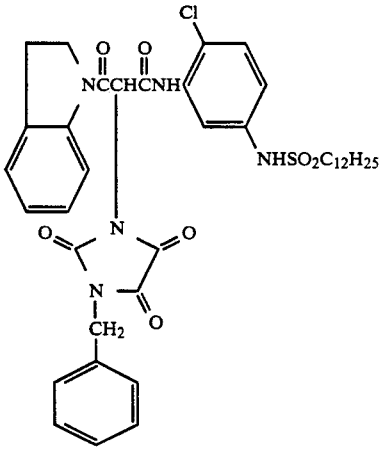
Y-32
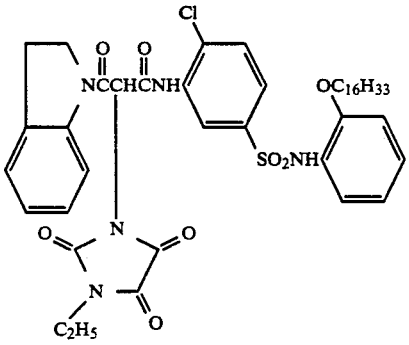
Y-33
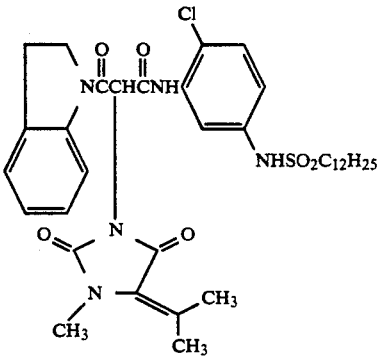
Y-34
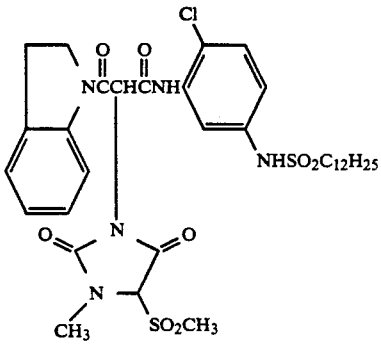
Y-35

-continued
Y-36
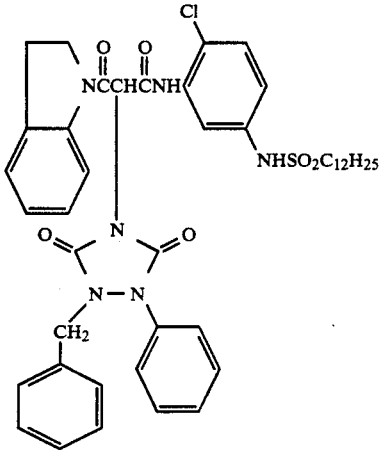
Y-37
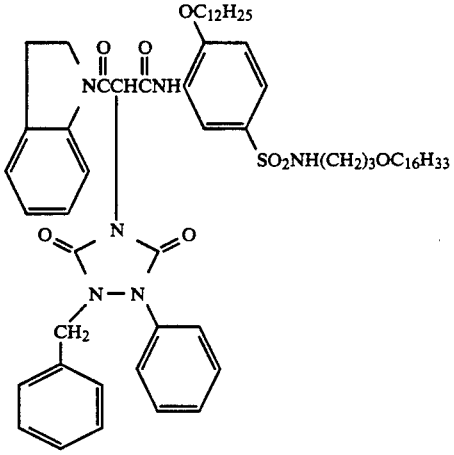
Y-38
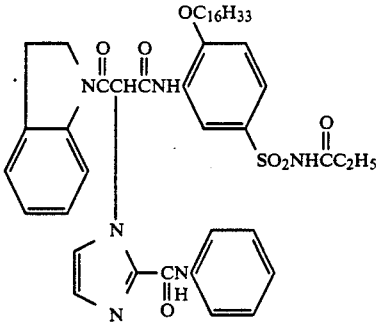
Y-39
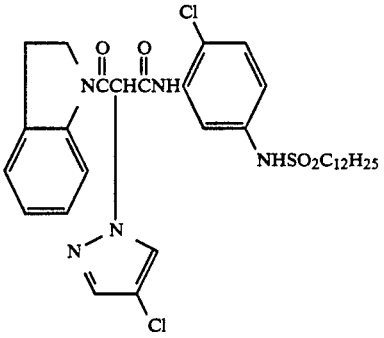
Y-40
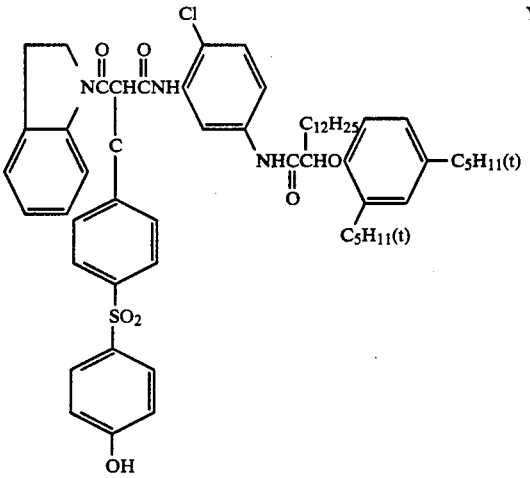
Y-41
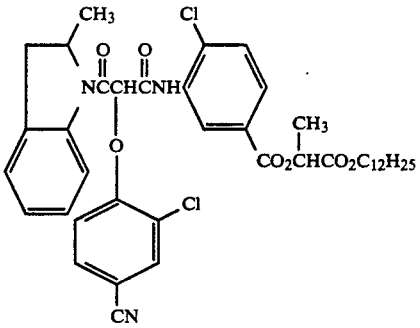

-continued
Y-42
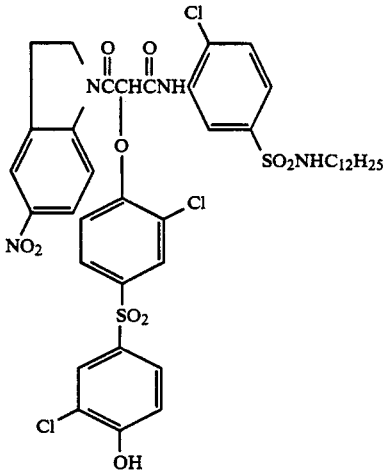
Y-43
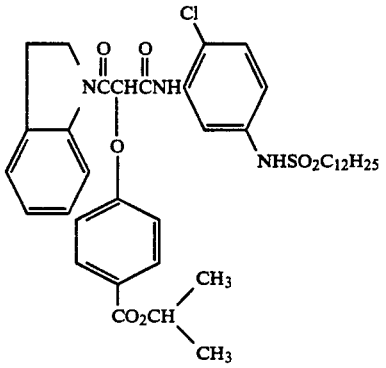
Y-44
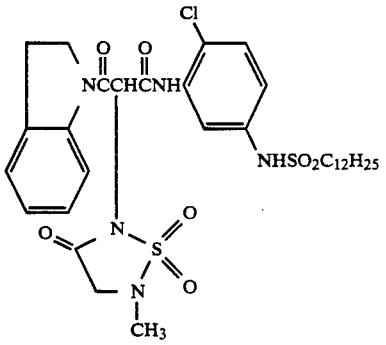
Y-45
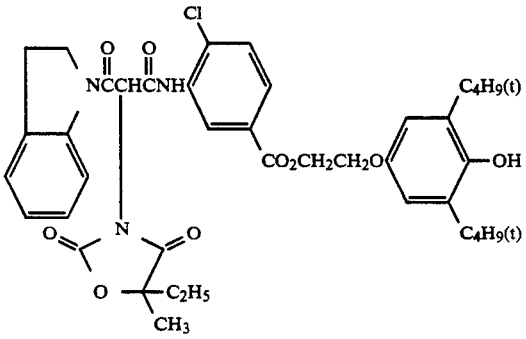
Y-46
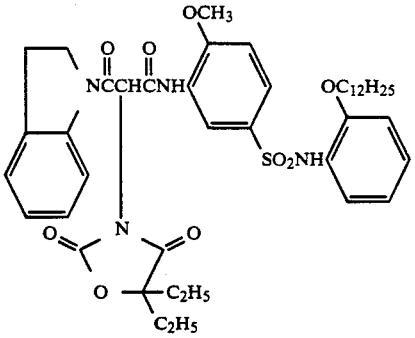
Y-47
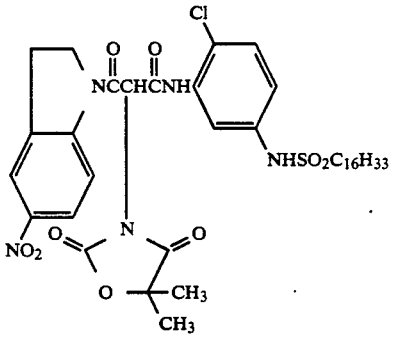
Y-48
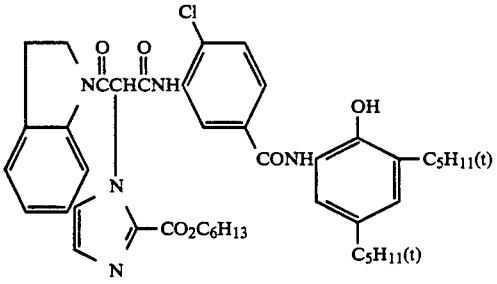
Y-49
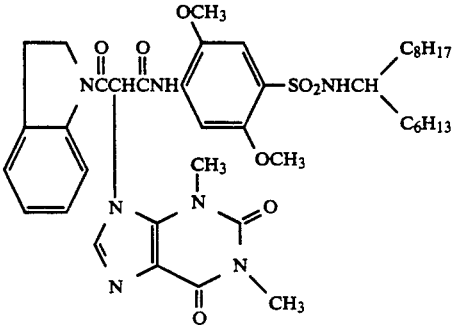

-continued
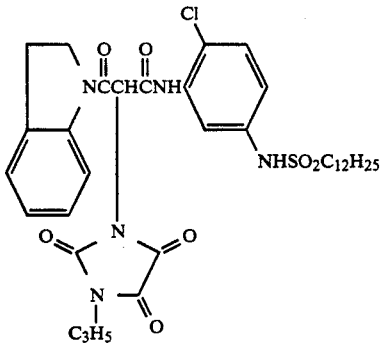
Y-50
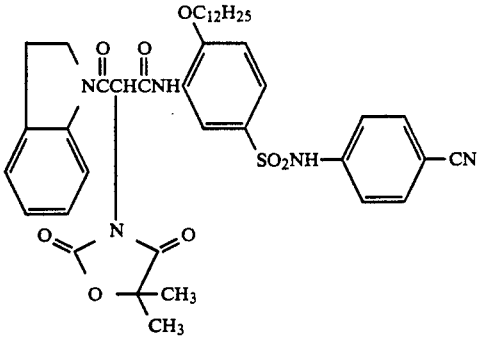
Y-51
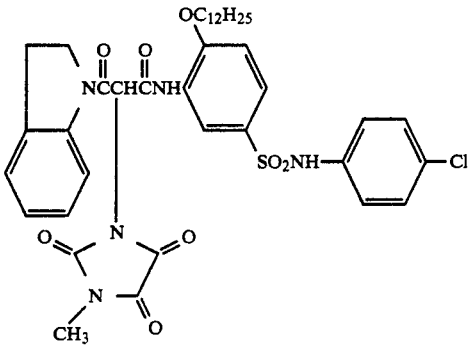
Y-52
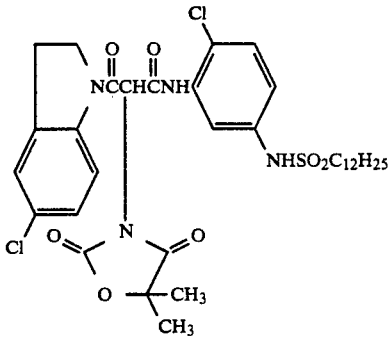
Y-53
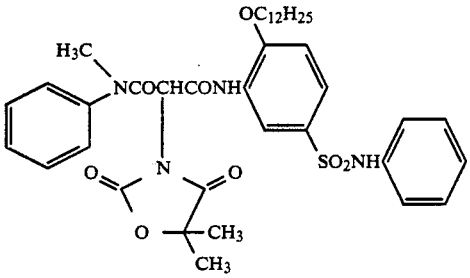
Y-54
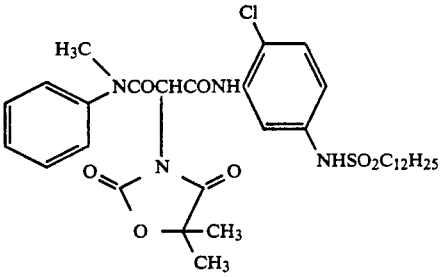
Y-55
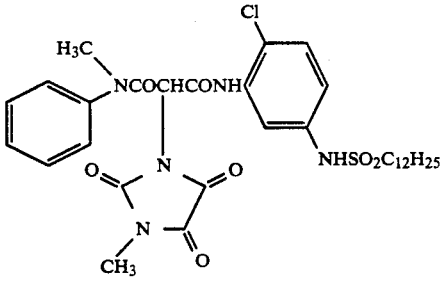
Y-56
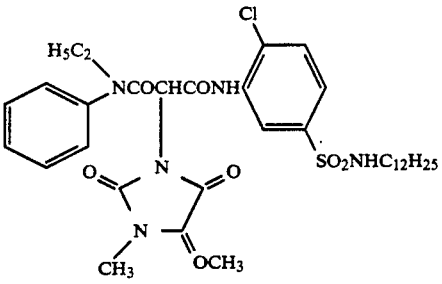
Y-57
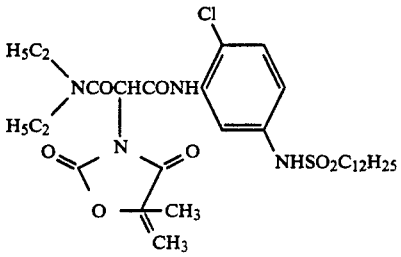
Y-58
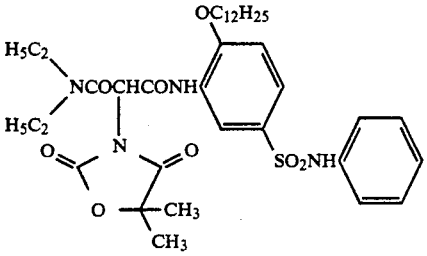
Y-59

-continued
Y-60
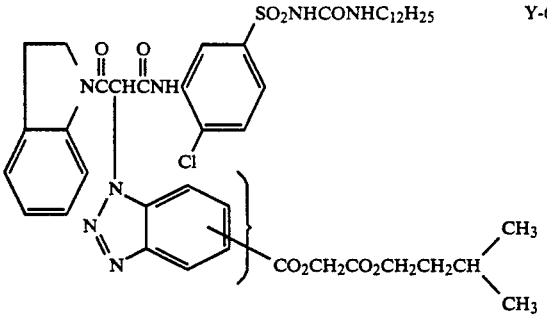
Y-61
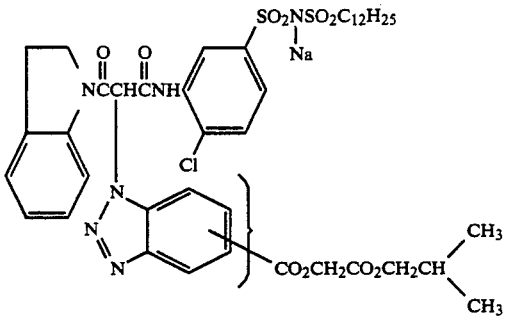
Y-62
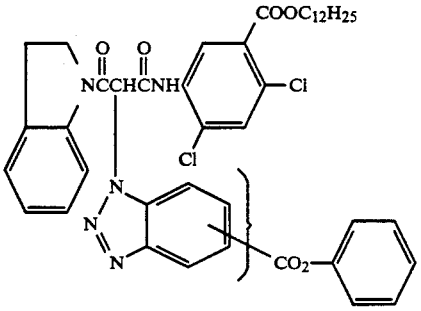
Y-63
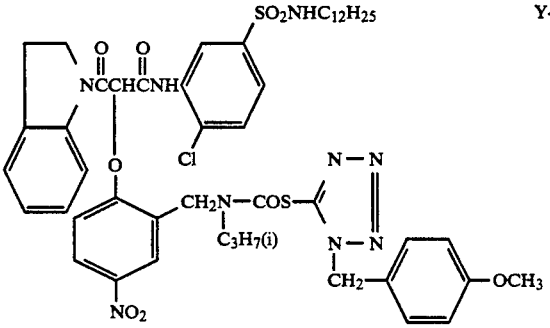
Y-64
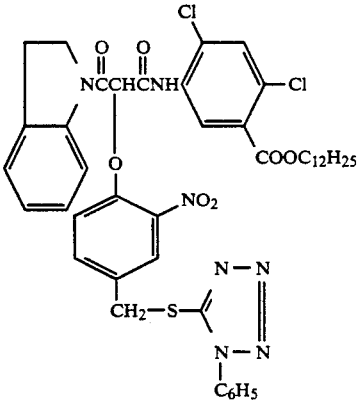
Y-65
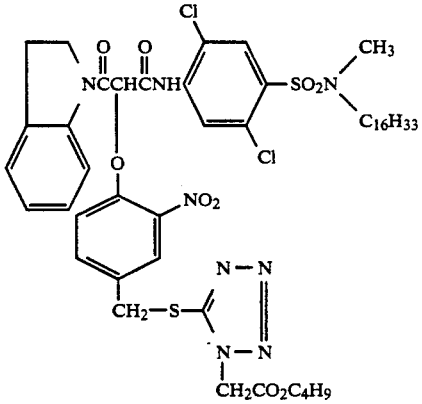
Y-66
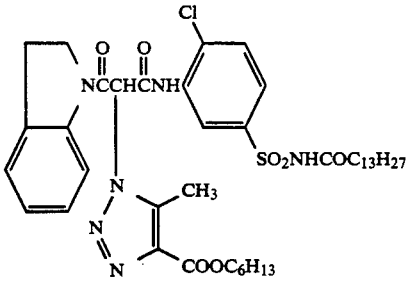
Y-67
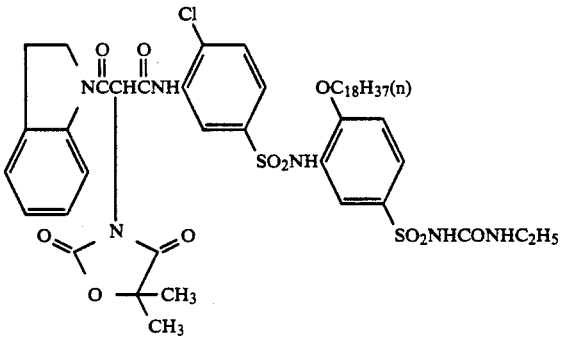

-continued

Y-68

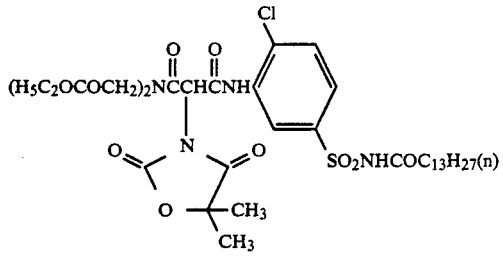

Y-69

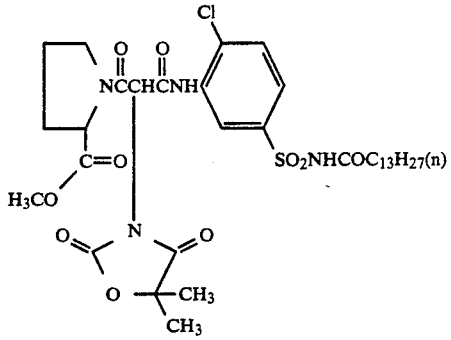

Y-70

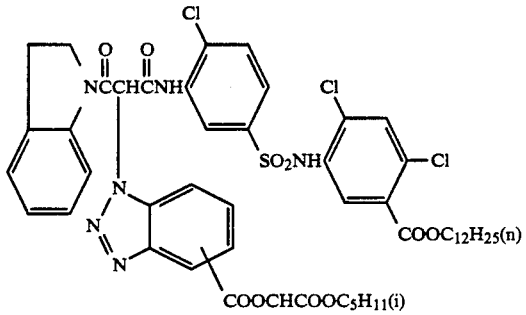

Synthesis examples of compounds represented by formulas (1) and (2) are shown below.

SYNTHESIS EXAMPLE 1

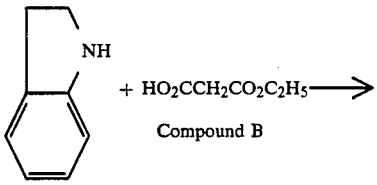

Compound A

Compound B

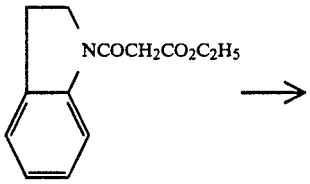

Intermediate A

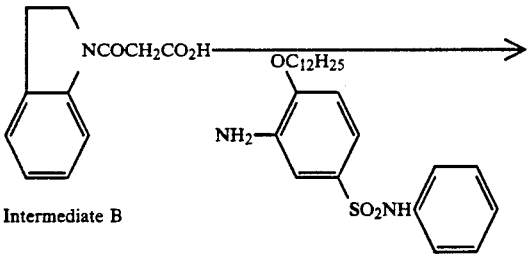

Intermediate B

Compound C

-continued

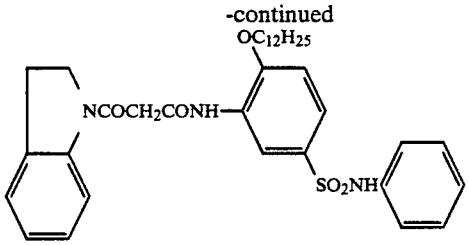

Intermediate D

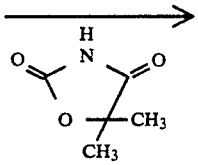

Compound D

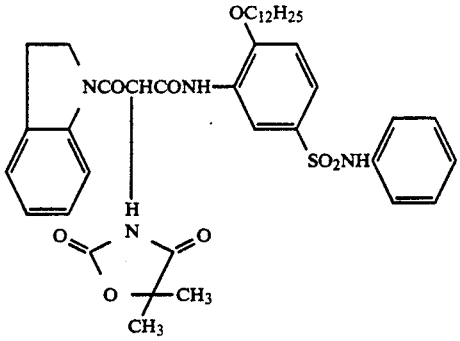

Exemplified Coupler Y-1

Synthesis of Intermediate B 357.5 g (3.0 mol) of Compound A and 396.3 g (3.0 mol) of Compound BA were dissolved in 1.2 liters of ethyl acetate and 0.6 liters of dimethylformamide. To the resulting solution, a solution of 631 g (3.06 mol) of dicyclohexylcarbodiimide in acetonitrile (400 ml) was added dropwise at 15° to 35° C. with stirring. After reacting for 2 hours at 20° to 30° C., the deposited dicyclohexyl urea was filtered off.

500 ml of ethyl acetate and 1 liter of water were added to the filtrate and the water layer was removed. Then, the organic layer was washed twice with 1 liter of water each time. After the organic layer was dried over anhydrous sodium sulfate, the ethyl acetate was distilled off under reduced pressure, to obtain an oil of 692 g (98.9%) of Intermediate A.

692 g (2.97 mol) of the Intermediate A was dissolved in 3 liters of ethyl alcohol and, to the resulting solution, 430 g of 30% sodium hydroxide was added dropwise at 75° to 80° C. with stirring. After the addition, the reaction was continued for 30 min at the same temperature and the deposited crystals were filtered (yield: 658 g).

The crystals were suspended in 5 liters of water and 300 ml of concentrated hydrochloric acid was added dropwise to the suspension at 40° to 50° C. After stirring for 1 hour at the same temperature, the crystals were filtered to obtain 579 g (95%) of Intermediate B (decomposition point: 127° C.).

Synthesis of Intermediate D 45.1 g (0.22 mol) of the Intermediate B and 86.6 g (0.2 mol) of Compound C were dissolved in 400 ml of ethyl acetate and 200 ml of dimethylacetamide. To the solution, a solution of 66 g (0.32 mol) of dicylohexylcarbodiimide in acetonitrile (100 ml) was added dropwise with stirring. After reacting for 2 hours at 20° to 30° C., the deposited dicyclohexyl urea was filtered off.

400 ml of ethyl acetate and 600 ml of water were added to the filtrate, and after the water layer was removed, the organic layer was washed with water twice. After the organic layer was dried over anhydrous sodium sulfate, the ethyl acetate was distilled off, to obtain 162 g of an oil.

This oil was crystallized from 100 ml of ethyl acetate and 300 ml of n-hexane, to obtain 108 g (87.1%) of Intermediate D. (melting point: 132° to 134° C.)

Elemental analysis of Intermediate D

| | C % | H % | N % |
|---|---|---|---|
| Calculated | 67.82 | 7.32 | 6.78 |
| Found | 67.81 | 7.32 | 6.76 |

Synthesis of Exemplified Coupler Y-1

49.6 g (0.08 mol) of the Intermediate D was dissolved in 300 ml of dichloromethane. To the solution, 11.4 g (0.084 mol) of sulfuryl chloride was added dropwise at 10° to 15° C. with stirring.

After reacting for 30 min at the same temperature, 200 g of a 5% aqueous sodium bicarbonate solution was added dropwise to the reaction mixture. After the organic layer was separated, it was washed with 200 ml of water and dried over anhydrous sodium sulfate. The dichloromethane was distilled off under reduced pressure, to obtain 47 g of an oil.

47 g of this oil was dissolved in 200 ml of acetonitrile and, to the solution, 28.4 g (0.22 mol) of Compound D and 22.2 g (0.22 mol) of triethylamine were added with stirring. After reacting for 4 hours at 40° to 50° C., the reaction mixture was poured into 300 ml of water, and the deposited oil was extracted with 300 ml of ethyl acetate. The organic layer was washed with 200 g of 5% aqueous sodium hydroxide solution and then twice with 300 ml of water each time. After the organic layer was acidified with diluted hydrochloric acid, the organic layer was washed with water twice and was concentrated under reduced pressure, to obtain a residue (yield: 70 g).

The obtained oily substance was crystallized from 50 ml of ethyl acetate and 100 ml of n-hexane, to obtain 47.8 g (80%) of Exemplified Coupler Y-1. (melting point: 145° to 147° C.)

Elemental analysis of Exemplified Coupler Y-1

| | C % | H % | N % |
|---|---|---|---|
| Calculated | 64.32 | 6.75 | 7.50 |
| Found | 64.31 | 6.73 | 7.50 |

SYNTHESIS EXAMPLE 2

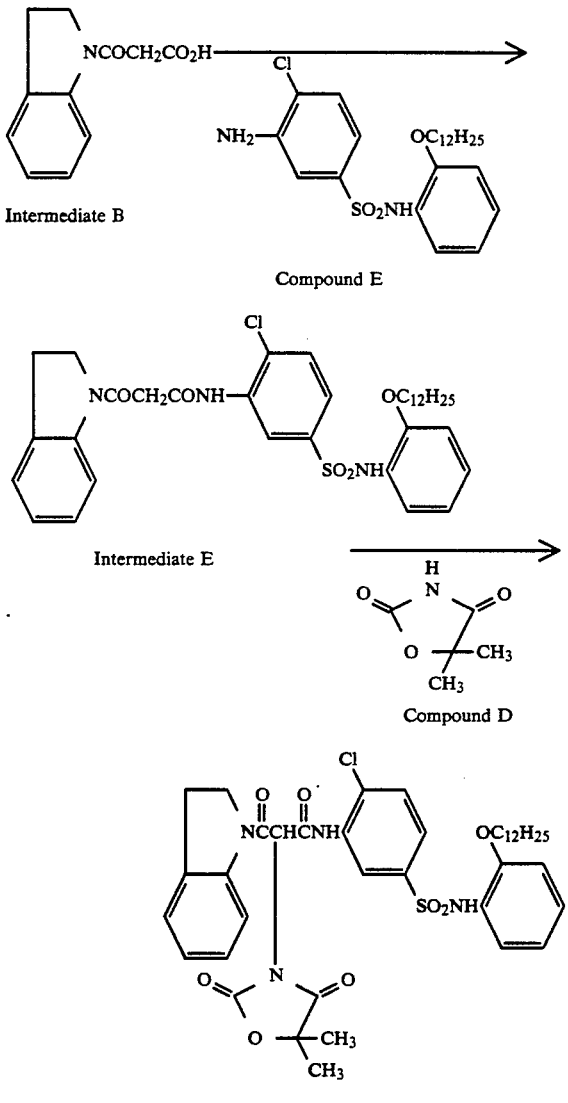

Synthesis of Intermediate E 90.3 g (0.44 mol) of the Intermediate B and 187 g (0.4 mol) of Compound E were dissolved in 500 ml of ethyl acetate and 300 ml of dimethylformamide. To the solution, a solution of 131.9 g (0.64 mol) of dicyclohexylcarbodiimide in acetonitrile (200 ml) was added dropwise at 15° to 30° C. with stirring.

After reacting for 2 hours at 20° to 30° C., the deposited dicyclohexyl urea was filtered off. To the filtrate, 500 ml of ethyl acetate and 600 ml of water were added, and after the water layer was removed, the organic layer was washed with water twice. After the organic layer was dried over anhydrous sodium sulfate, the ethyl acetate was distilled off under reduced pressure, to obtain 281 g of an oil. The oil was dissolved in 1.5 liters of n-hexane by heating, and undissolved matter was filtered and removed. The n-hexane solution was cooled with water, and the deposited Intermediate E was filtered. The yield was 243.4 g (93%) and the melting point was 103° to 105° C.

Elemental analysis of Intermediate E

| | C % | H % | N % |
|---|---|---|---|
| Calculated | 64.25 | 6.78 | 6.42 |
| Found | 64.24 | 6.76 | 6.43 |

Synthesis of Exemplified Coupler Y-10

39.3 g (0.06 mol) of the Intermediate E was dissolved in 200 ml of dichloromethane. To the solution, 8.7 g (0.064 mol) of sulfuryl chloride was added dropwise at 10° to 15° C. with stirring.

After reacting for 30 min at the same temperature, 200 g of a 4% aqueous sodium bicarbonate solution was added dropwise to the reaction mixture. After the organic layer was separated, it was washed with 200 ml of water and dried over anhydrous sodium sulfate. The dichloromethane was distilled off under reduced pressure, to obtain 41.3 g of an oil.

41.3 g of this oil was dissolved in 100 ml of acetonitrile and 200 ml of dimethylacetamide and, to the solution, 20.8 g (0.16 mol) of Compound D and 16.2 g of triethylamine were added with stirring. After reacting for 3 hours at 30° to 40° C., the reaction mixture was poured into 400 ml of water, and the deposited oil was extracted with 300 ml of ethyl acetate. The organic layer was washed with 300 g of 2% aqueous sodium hydroxide solution, and then with water twice. Then after the organic layer was acidified with diluted hydrochloric acid, the organic layer was washed with water twice and was concentrated under reduced pressure, to obtain 42 g of a residue.

The residue was crystallized from 200 ml of methanol, to obtain 39.8 g (85%) of Exemplified Coupler Y-10. (melting point: 110° to 112° C.)

Elemental analysis of Exemplified Coupler Y-10

| | C % | H % | N % |
|---|---|---|---|
| Calculated | 61.48 | 6.32 | 7.17 |
| Found | 61.46 | 6.30 | 7.18 |

SYNTHESIS EXAMPLE 3

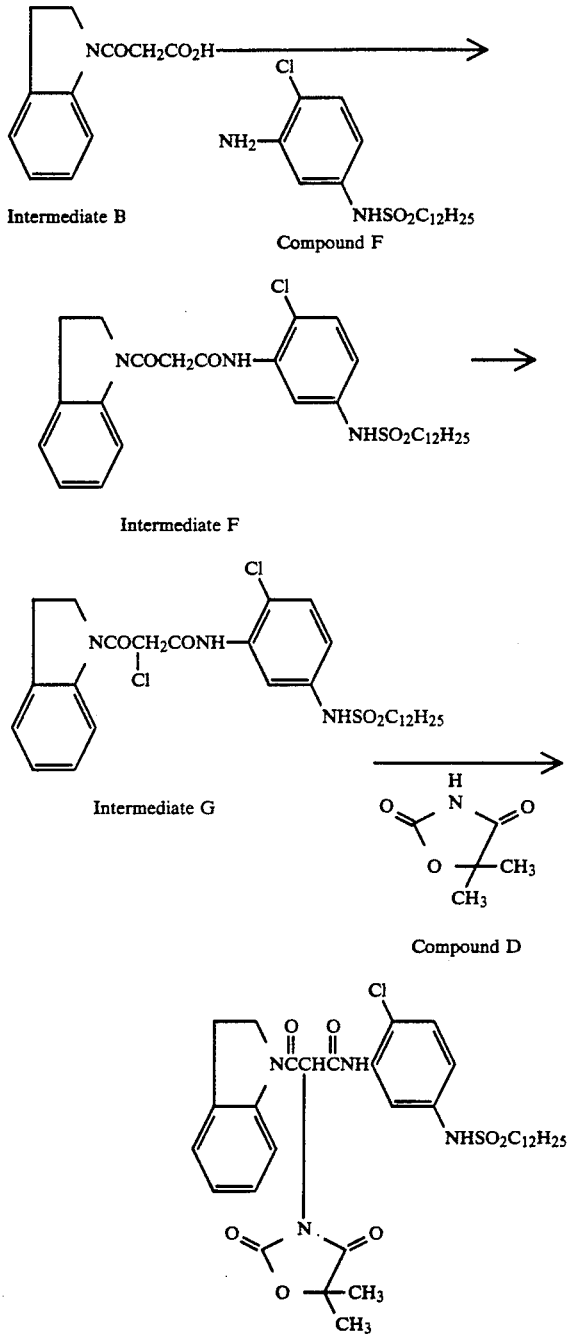

Synthesis of Intermediate F 104.7 g (0.51 mol) of the Intermediate B and 187.5 g (0.5 mol) of Compound F were dissolved in 1 liter of ethyl acetate and 400 ml of dimethylformamide. To the solution, a solution of 107.3 g (0.525 mol) of dicyclohexylcarbodiimide in dimethylformamide (100 ml) was added dropwise at 15° to 30° C. with stirring.

After reacting for 1 hour at 20° to 30° C., 500 ml of ethyl acetate was added; then the reaction mixture was heated to 50° to 60° C., and dicyclohexyl urea was filtered off.

To the filtrate, 600 ml of water was added, and after the water layer was removed, washing with water was carried out twice. After the organic layer was dried over anhydrous sodium sulfate, the ethyl acetate was distilled off under reduced pressure, to obtain 290 g of an oil. The oil was heated together with 1 liter of ethyl acetate and 2 liters of methanol; then undissolved matter was filtered and removed, and upon cooling of the filtrate with water, crystals of Intermediate F deposited, which were filtered. The yield was 267 g (95%) and the melting point was 163° to 164° C.

| Elemental analysis of Intermediate F | | | |
|---|---|---|---|
| | C % | H % | N % |
| Calculated | 61.95 | 7.17 | 7.48 |
| Found | 67.93 | 7.17 | 7.46 |

Synthesis of Intermediate G 114.0 g (0.2 mol) of the Intermediate G was dissolved in 500 ml of dichloromethane. To the solution, 28.4 g (0.21 mol) of sulfuryl chloride was added dropwise at 10° to 15° C. with stirring.

After reacting for 30 min at the same temperature, 500 g of a 6% aqueous sodium bicarbonate solution was added dropwise to the reaction mixture. After the organic layer was separated, it was washed with 500 ml of water and dried over anhydrous sodium sulfate. The dichloromethane was distilled off under reduced pressure, to deposit crystals of Intermediate G, which were filtered. Yield: 108.6 g (91%)

Synthesis of Exemplified Coupler Y-6

29.8 g (0.05 mol) of the Intermediate G was dissolved in 80 ml of dimethylformamide, 12.9 g (0.1 mol) of Compound D was added to the solution, and then 10.1 g (0.01 mol) of triethylamine was added dropwise thereto at 20° to 30° C. with stirring. After reacting at 40° to 45° C. for 1 hour, 300 ml of ethyl acetate and 200 ml of water were added to the reaction mixture.

After the organic layer was washed twice with 400 g of 2% aqueous sodium hydroxide solution, the organic layer was washed with water once. After the organic layer was acidified with diluted hydrochloric acid, the organic layer was washed with water twice and was concentrated, to obtain 24 g of a residue. The residue was crystallized from a mixed solvent of 50 ml of ethyl acetate and 150 ml of n-hexane, to obtain 19 g of Exemplified Coupler Y-6.

The crystals were recrystallized from 120 ml of a mixed solvent of ethyl acetate/n-hexane (⅓ in vol/vol), to obtain 15 g (43.5%) of Exemplified Coupler Y-6. (melting point: 135° to 136° C.)

| Elemental analysis of Exemplified Coupler Y-6 | | | |
|---|---|---|---|
| | C % | H % | N % |
| Calculated | 59.24 | 6.58 | 8.13 |
| Found | 59.27 | 6.56 | 8.12 |

SYNTHESIS EXAMPLE 4

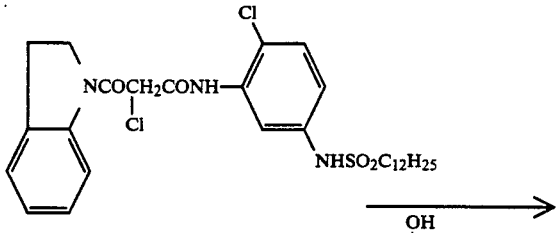

Intermediate G

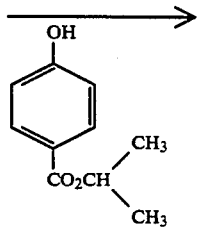

Compound G

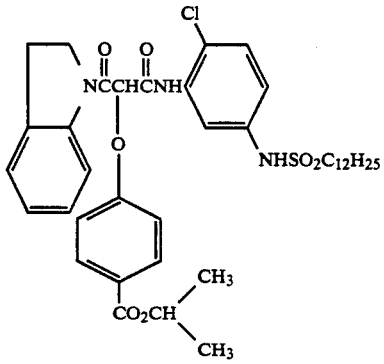

Exemplified Coupler Y-43

SYNTHESIS EXAMPLE Y-43

27.0 g (0.15 mol) of the Intermediate G and 15.2 g (0.15 mol) of triethylamine were dissolved in 50 ml of dimethylformamide. To this mixture, a solution of 9.8 g (0.005 mol) of the Intermediate G in dimethylformamide (30 ml) was added dropwise with stirring.

After reacting for 4 hours at 30° to 40° C., 400 ml of ethyl acetate and 300 ml of water were added to the reaction mixture. The organic layer was washed twice with 400 g of 2% aqueous sodium hydroxide solution and then with water twice. After the organic layer was acidified with diluted hydrochloric acid, the organic layer was washed with water twice and was dried over anhydrous sodium sulfate. The ethyl acetate was distilled off under reduced pressure, to obtain 54 g of a residue.

The residue was crystallized from 300 ml of a mixed solvent of ethyl acetate/methanol (½ in vol/vol) and the crystals were filtered, to obtain Exemplified Coupler Y-43. The obtained crystals were recrystallized from 200 ml of a mixed solvent of ethyl acetate/methanol (½ in vol/vol) to obtain 28.8 g (77.8%) of Exemplified Coupler Y-43. (melting point: 190° to 191° C.)

| Elemental analysis of Exemplified Coupler Y-6 | | | |
|---|---|---|---|
| | C % | H % | N % |
| Calculated | 63.26 | 6.81 | 5.68 |

-continued

| Elemental analysis of Exemplified Coupler Y-6 | | | |
|---|---|---|---|
| | C % | H % | N % |
| Found | 63.24 | 6.79 | 5.67 |

Phenol series cyan couplers represented by formula (C) will now be described in detail below.

In formula (C), $R_1$ represents a straight-chain, branched chain, or cyclic, unsaturated or saturated alkyl group that may be substituted and preferably has a total carbon number (hereinafter referred to as C-number) of 1 to 36 (more preferably 1 to 24), an aryl group that may be substituted and preferably has a C-number of 6 to 36 (more preferably 6 to 24), or a heterocyclic group that may be substituted and preferably has a C-number of 2 to 36 (more preferably 2 to 24). Herein the term "a heterocyclic group" means a 5- to 7-membered heterocyclic group that may be condensed and has at least one heteroatom selected from the group consisting of non-metal atoms of N, O, S, P, Se, and Te, and examples thereof are 2-furyl, 2-ethyl, 4-pyridyl, 2-imidazolyl, and 4-quinolyl. Examples of a substituent of $R_2$ include a halogen atom, a cyano group, a nitro group, a carboxyl group, a sulfo group, an alkyl group, an aryl group, a heterocyclic group, an alkoxy group, an aryloxy group, an alkylthio group, an arylthio group, an alkylsulfonyl group, an arylsulfonyl group, an alkoxycarbonyl group, an aryloxycarbonyl group, an acyl group, a carbonamido group, a sulfonamido group, a carbamoyl group, a sulfamoyl group, a ureido group, an alkoxycarbonyl group, or a sulfamoylamino group (these will be referred to hereinafter as substituent group A), and a preferable substituent includes a halogen atom (e.g., F, Cl, Br, and I), a cyano group, an alkyl group, an aryloxy group, an alkylsulfonyl group, an arylsulfonyl group, a carbonamido group, or a sulfonamido group. In formula (C), preferably $R_1$ is an alkyl group.

In formula (C), $R_2$ represents a straight-chain, branched chain, or cyclic alkyl group preferably having a C-number of 2 to 36 (more preferably 2 to 24). More preferably $R_2$ represents an alkyl group having a C-number of 2 to 8 (e.g., ethyl, propyl, isopropyl, t-butyl, and cyclopentyl).

In formula (C), $R_3$ represents a hydrogen atom, a halogen atom (e.g., F, Cl, Br, and I), a straight-chain, branched chain, or cyclic alkyl group preferably having a C-number of 1 to 16 (more preferably 1 to 8), an aryl group preferably having a C-number of 6 to 24 (more preferably 6 to 12), an alkoxy group preferably having a C-number of 1 to 24 (more preferably 1 to 8), an aryloxy group preferably having a C-number of 6 to 24 (more preferably 6 to 12), a carbonamido group preferably having a C-number of 1 to 24 (more preferably 2 to 12), or a ureido group preferably having a C-number of 1 to 24 (more preferably 1 to 12). Herein, if $R_3$ is an alkyl group, an aryl group, an alkoxy group, an aryloxy group, a carbonamido group, or a ureido group, the group may be substituted by a substituent selected from the above substituent group A. In formula (C), $R_3$ preferably represents a halogen atom.

In formula (C), X represents a hydrogen atom or a group capable of being released upon a coupling reaction with the oxidized product of an aromatic primary amine developing agent (hereinafter referred to as coupling split-off group). Specific example of the coupling split-off group are a halogen atom (e.g., F, Cl, Br, and I), a sulfo group, an alkoxy group having a C-number of 1 to 36 (preferably 1 to 24), an aryloxy group having a C-number of 6 to 36 (preferably 6 to 24), an acyloxy group having a C-number of 2 to 36 (preferably 2 to 24), an alkyl or arylsulfonyloxy group having a C-number of 1 to 36 (preferably 1 to 24), an alkylthio group having a C-number of 1 to 36 (preferably 1 to 24), an arylthio group having a C-number of 6 to 36 (preferably 6 to 24), an imido group having a C-number of 4 to 36 (preferably 4 to 24), a carbamoyloxy group having a C-number of 1 to 36 (preferably 1 to 24), or a heterocyclic group having a C-number of 1 to 36 (preferably 2 to 24) and bonded to the coupling active site through the nitrogen atom (e.g., tetrazol-5-yl, pyrazolyl, imidazolyl, and 1,2,4-triazol-1-yl). Herein the alkoxy group and the groups mentioned after the alkoxy group may be substituted by a substituent selected from the above-mentioned substituent group A. X preferably is a hydrogen atom, a fluorine atom, a chlorine atom, a sulfo group, an alkoxy group, or an aryloxy group, with more preference given to a hydrogen atom or a chlorine atom.

In formula (C), n represents an integer of 0 or 1, preferably 0.

Examples of each substituent in formula (C) are shown below.

Examples of $R_1$:

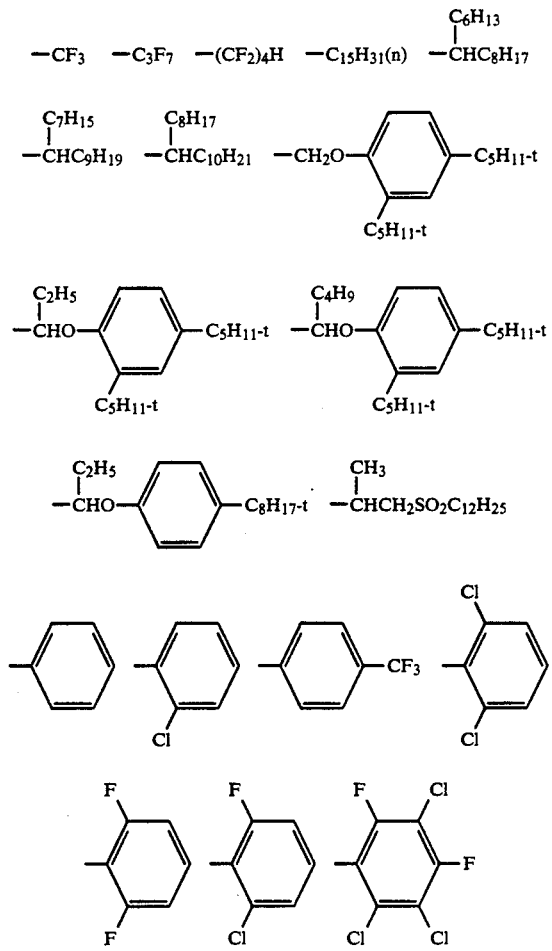

-continued
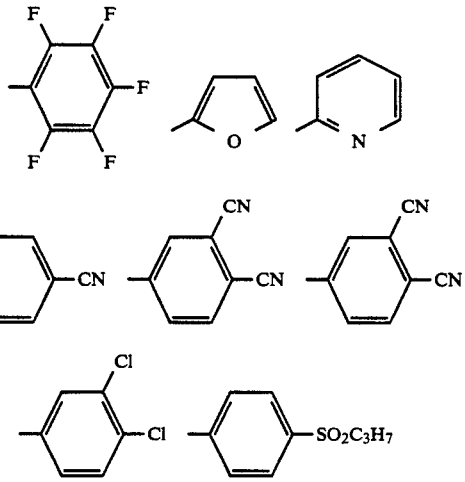
Examples of $R_2$:
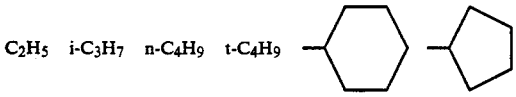
Examples of $R_3$:
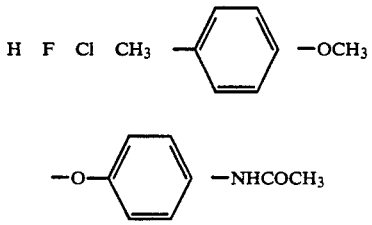
Examples of X:
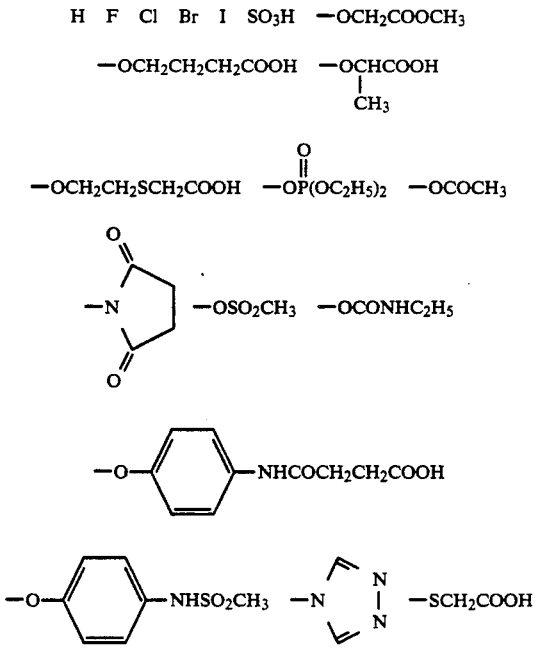
-continued
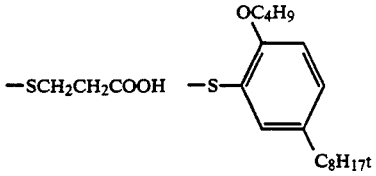
Examples of Coupler represented by formula (C) are shown below.
C-1
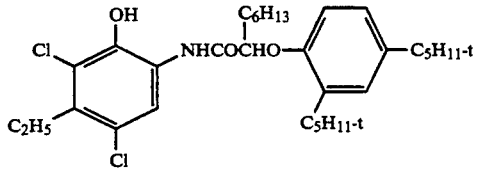
C-2
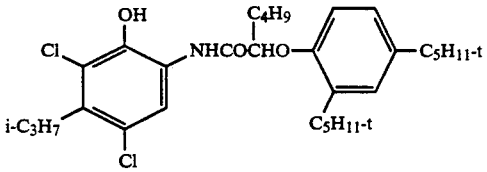
C-3
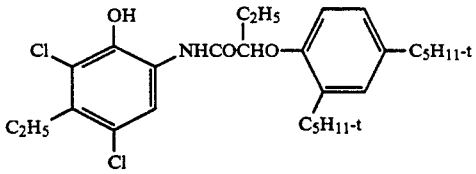
C-4
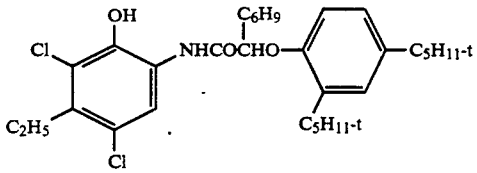
C-5
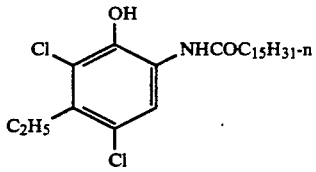
C-6
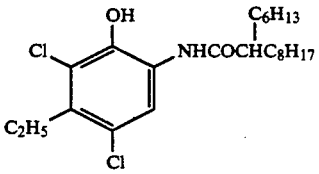
C-7
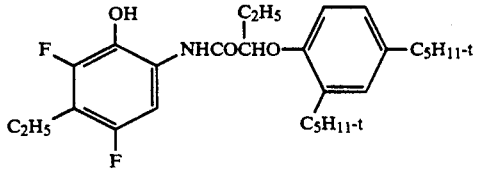

-continued

C-8

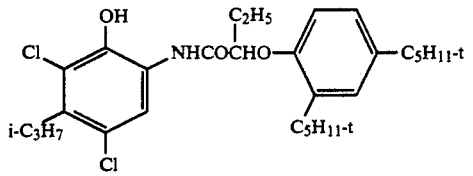

C-9

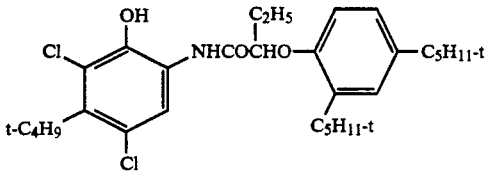

C-10

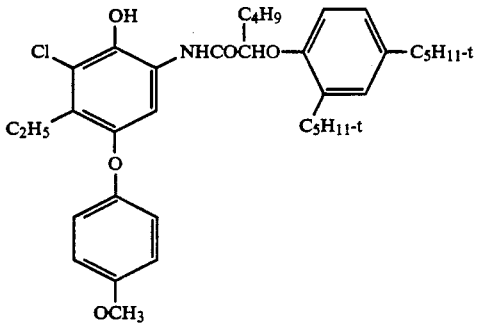

Specified examples of couplers other than the above and the synthesis method of these couplers are described in, for example, U.S. Pat. Nos. 2,369,929, 2,772,162, 2,895,826, 3,772,002, 4,327,173, 4,333,999, 4,334,011, 4,430,423, 4,500,635, 4,518,687, 4,564,586, 4,609,619, 4,686,177, and 4,746,602, and JP-A No. 164555/1984.

The cyan color-forming layer, magenta color-forming layer, and yellow color-forming layer of the present invention are generally a red-sensitive layer, a green-sensitive layer, and a blue-sensitive layer, respectively, but these correspondences are not necessarily the case, respective layers may be, for example, an infrared-sensitive layer, an infrared-sensitive layer, and a red-sensitive layer. In the present invention, the yellow color-forming layer is preferably applied on a nearest position to the support, followed by applying the magenta color-forming layer and the cyan color-forming layer. With respect to the order of applying the magenta color-forming layer and the cyan color-forming layer, any order may be used.

Although, as a silver halide used in the present invention, for example, silver chloride, silver bromide, silver bromo(iodo)chloride, and silver bromoiodide can be used, particularly if rapid processing is intended, a silver chloride emulsion or a silver bromochloride emulsion substantially free from silver iodide and having a silver chloride content of 90 mol. % or more, preferably 95 mol. % or more, particularly preferably 98 mol. % or more, is used preferably.

In the photographic material according to the present invention, in order to improve, for example, sharpness of the image, preferably a dye that can be decolored by processing (in particular an oxonol dye), as described in European Patent EP 0,337,490A2, pages 27 to 76, is added to a hydrophilic layer, so that the optical reflection density of the photographic material at 680 nm may be 0.70 or over, or 12 wt. % or more (preferably 14 wt. % or more) of titanium oxide the surface of which has been treated with secondary to quaternary alcohol (e.g., trimethylolethane) or the like is contained in a water-resistant resin layer of the support.

Yellow couplers or cyan couplers of the present invention may be used in combination with other yellow couplers or cyan couplers than those of the present invention. In the present invention, as a yellow coupler, a magenta coupler, and a cyan coupler can be used those described in patents shown in the table below. As magenta coupler pyrazoloazole series couplers are particularly preferable.

In the present invention, the coating amount of coupler in each layer is preferably 0.1 to 2 mmol, more preferably 0.3 to 1.3 mmol, per square meter of photographic material. The coating amount of silver halide emulsion in a silver halide emulsion layer is preferably 2 to 10 mol (in terms of Ag atom), more preferably 2 to 5 mol, per mol of coupler.

As a high-boiling organic solvent for photographic additives, such as cyan, magenta, and yellow couplers that can be used in the present invention, any compound can be used if the compound has a melting point of 100° C. or below and a boiling point of 140° C. or over; if it is immiscible with water; and if it is a good solvent for the coupler. The melting point of the high-boiling organic solvent is preferably 80° C. or below and the boiling point of the high-boiling organic solvent is preferably 160° C. or over, more preferably 170° C. or over.

Details of these high-boiling organic solvents are described in JP-A No. 215272/1987, from page 137 (right lower column) to page 144 (right upper column).

The cyan, magenta, or yellow coupler can be emulsified and dispersed into a hydrophilic colloid, by impregnating into a loadable latex polymer (e.g., see U.S. Pat. No. 4,203,716) in the presence or absence of the above high-boiling organic solvent or by dissolving into a polymer insoluble in water but soluble in organic solvents.

Preferably, homopolymers and copolymers described in U.S. Pat. No. 4,857,449 and International Publication WO 88/00723, pages 12 to 30, are used, and more preferably methacrylate polymers or acrylamide polymers, particularly preferably acrylamide polymers, are used because, for example, the color image is stabilized.

In the photographic material according to the present invention, preferably together with the coupler a color image preservability-improving compound, as described in European Patent EP 0,277,589A2, is used. Particularly a combination with a pyrazoloazole coupler is preferable.

That is, when a compound (F), which will chemically combine with the aromatic amine developing agent remaining after the color development processing to form a chemically inactive and substantially colorless compound, and/or a compound (G), which will chemically combine with the oxidized product of the aromatic amine color developing agent remaining after the color development processing to form a chemically inactive and substantially colorless compound, are used simultaneously or singly, it is preferable because occurrence of stain and other side effects, for example, due to the production of a color-formed dye by reaction of the coupler with the color-developing agent or its oxidized product remaining in the film during the storage after the processing, can be prevented.

To the photographic material according to the present invention, a mildew-proofing agent described, for example, in JP-A No. 271247/1988, is preferably added in order to prevent the growth of a variety of mildews and fungi that will propagate in the hydrophilic layer and deteriorate the image thereon.

As a support to be used for the photographic material of the present invention, a white polyester support for display may be used, or a support wherein a layer containing white pigment is provided on the side that will have a silver halide layer. Further, in order to improve sharpness, preferably an anti-halation layer is applied on the side of the support where the silver halide layer is applied or on the undersurface of the support. In particular, preferably the transmission density of the base is set in the range of 0.35 to 0.8, so that the display can be appreciated through either reflected light or transmitted light.

The photographic material of the present invention may be exposed to visible light or infrared light. The method of exposure may be low-intensity exposure or high-intensity short-time exposure, and particularly in the later case, the laser scan exposure system, wherein the exposure time per picture element is less than $10^{-4}$ sec is preferable.

When exposure is carried out, the band stop filter, described in U.S. Pat. No. 4,880,726, is preferably used. Thereby light color mixing is eliminated and the color reproduction is remarkably improved.

The exposed photographic material may be subjected to conventional color development processing, and then preferably it is subjected to bleach-fix processing for the purpose of rapid processing. In particular, when the above-mentioned high-silver-chloride emulsion is used, the pH of the bleach-fix solution is preferably about 6.5 or below, more preferably about 6 or below, for the purpose of the acceleration of desilvering.

With respect to silver halide emulsions, other materials (e.g., additives) and photographic component layers (e.g., layer arrangement) that will be applied to the photographic material of the present invention, as well as processing methods and processing additives that will be applied to the photographic material of the present invention, particularly those described in below-mentioned patent publications, particularly in European Patent EP 0,355,660A2 (JP-A No. 139544/1990), are preferably used.

| Element constituting photographic material | JP-A No. 215272/1987 | JP-A No. 33144/1990 | EP 0,355,660A2 |
|---|---|---|---|
| Silver halide emulsion | p. 10 upper right column line 6 to p. 12 lower left column line 5, and p. 12 lower right column line 4 from the bottom to p. 13 upper left column line 17 | p. 28 upper right column line 16 to p. 29 lower right column line 11 and p. 30 lines 2 to 5 | p. 45 line 53 to p. 47 line 3 and p. 47 lines 20 to 22 |
| Solvent for silver halide | p. 12 lower left column line 6 to 14 and p. 13 upper left column line 3 from the bottom to p. 18 lower left column last line | — | — |
| Chemical sensitizing agent | p. 12 lower left column line 3 from the bottom to lower right column line 5 from the bottom and p. 18 lower right column line 1 to p. 22 upper right column line 9 from the bottom | p. 29 lower right column line 12 to last line | p. 47 lines 4 to 0 |
| Spectral sensitizing agent (method) | p. 22 upper right column line 8 from the bottom to p. 38 last line | p. 30 upper left column lines 1 to 13 | p. 47 lines 10 to 15 |
| Emulsion stabilizer | p. 39 upper left column line 1 to p. 72 upper right column last line | p. 30 upper left column line 14 to upper right column line 1 | p. 47 lines 16 to 19 |
| Developing accelerator | p. 72 lower left column line 1 to p. 91 upper right column line 3 | — | — |
| Color coupler (Cyan, Magenta, and Yellow coupler) | p. 91 upper right column line 4 to p. 121 upper left column line 6 | p. 3 upper right column line 14 to p. 18 upper left column last line and p. 30 upper right column line 6 to p. 35 lower right column line 11 | p. 4 lines 15 to 27, p. 5 line 30 to p. 28 last line, p. 45 lines 29 to 31 and p. 47 line 23 to p. 63 line 50 |
| Color Formation-strengthen agent | p. 121 upper left column line 7 to p. 125 upper right column line 1 | — | — |
| Ultra violet absorbent | p. 125 upper right column line 2 to p. 127 lower left column last line | p. 37 lower right column line 14 to p. 38 upper left column line 11 | p. 65 lines 22 to 31 |
| Discoloration inhibitor (Image-dye stabilizer) | p. 127 lower right column line 1 to p. 137 lower left column line 8 | p. 36 upper right column line 12 to p. 37 upper left column line 19 | p. 4 line 30 to p. 5 line 23, p. 29 line 1 to p. 45 line 25 p. 45 lines 33 to 40 and p. 65 lines 2 to 21 |
| High-boiling | p. 137 lower left column | p. 35 lower right column | p. 64 lines 1 to 51 |

-continued

| Element constituting photographic material | JP-A No. 215272/1987 | JP-A No. 33144/1990 | EP 0,355,660A2 |
|---|---|---|---|
| and/or low-boiling solvent | line 9 to p. 144 upper right column last line | line 14 to p. 36 upper left column line 4 | |
| Method for dispersing additives for photograph | p. 144 lower left column line 1 to p. 146 upper right column line 7 | p. 27 lower right column line 10 to p. 28 upper left column last line and p. 35 lower right column line 12 to p. 36 upper right column line 7 | p. 63 line 51 to p. 64 line 56 |
| Film Hardener | p. 146 upper right column line 8 to p. 155 lower left column line 4 | — | — |
| Developing Agent precursor | p. 155 lower left column line 5 to p. 155 lower right column line 2 | — | — |
| Compound releasing development restrainer | p. 155 lower right column lines 3 to 9 | — | — |
| Base | p. 155 lower right column line 19 to p. 156 upper left column line 14 | p. 38 upper right column line 18 to p. 39 upper left column line 3 | p. 66 line 29 to p. 67 line 13 |
| Constitution of photosensitive layer | p. 156 upper left column line 15 to p. 156 lower right column line 14 | p. 28 upper right column lines 1 to 15 | p. 45 lines 41 to 52 |
| Dye | p. 156 lower right column line 15 to p. 184 lower ringt column last line | p. 38 upper left column line 12 to upper right column line 7 | p. 66 lines 18 to 22 |
| Color-mix inhibitor | p. 185 upper left column line 1 to p. 188 lower right column line 3 | p. 36 upper right column lines 8 to 11 | p. 64 line 57 to p. 65 line 1 |
| Gradation controller | p. 188 lower right column lines 4 to 8 | — | — |
| Stain inhibitor . | p. 188 lower right column line 9 to p. 193 lower right column line 10 | p. 37 upper left column last line to lower right column line 13 | p. 65 line 32 to p. 66 line 1 |
| Surface-active agent | p. 201 lower left column line 1 to p. 210 upper right column last line | p. 18 upper right column line 1 to p. 24 lower right column last line and p. 27 lower left column line 10 from the bottom to lower right column line 9 | — |
| Fluorine-containing agent (As Antistatic agent, coating aid, lubricant, adhesion inhibitor, or the like) | p. 210 lower left column line 1 to p. 222 lower left column line 5 | p. 25 upper left column line 1 to p. 27 lower right column line 9 | — |
| Binder (Hydrophilic colloid) | p. 222 lower left column line 6 to p. 225 upper left column last line | p. 38 upper right column lines 8 to 18 | p. 66 lines 23 to 28 |
| Thickening agent | p. 225 upper right column line 1 to p. 227 upper right column line 2 | — | — |
| Antistatic agent | p. 227 upper right column line 3 to p. 230 upper left column line 1 | — | — |
| Polymer latex latex | p. 230 upper left column line 2 to p. 239 last line | — | — |
| Matting agent | p. 240 upper left column line 1 to p. 240 upper right column last line | — | — |
| Photographic processing method (processing process, additive, etc.) | p. 3 upper right column line 7 to p. 10 upper right column line 5 | p. 39 upper left column line 4 to p. 42 upper left column fast line | p. 67 line 14 to p. 69 line 28 |

Note:
In the cited part of JP-A No. 21572/1987, amendment filed on March 16, 1987 is included.

Further, as cyan couplers for combination use, diphenylimidazole series cyan couplers described in JP-A No. 33144/1990, as well as 3-hydroxypyridine series cyan couplers described in European Patent EP 0,333,185A2 (in particular one obtained by causing Coupler (42), which is a four-equivalent coupler, to have a chlorine coupling split-off group, thereby rendering it two-equivalent, and Couplers (6) and (9), which are listed as specific examples, are preferable) and cyclic active methylene cyan dye-forming couplers described in JP-A No. 32260/1990 (in particular, specifically listed Coupler Examples 3, 8, and 34 are preferable) are preferably used.

As a method for color development processing of a photographic material using a high-silver-chloride emulsion having a silver chloride content of 90 mol. % or more, the method described in, for example, JP-A No. 207250/1990, page 27 (the left upper column) to page 34 (the right upper column), is preferably used.

According to the present invention, a color photographic material excellent in the color formation of cyan can be obtained. Further, the wet-and-heat fading of color-formed image of cyan and yellow obtained by this photographic material are remarkably restricted, and as the result, a color photograph improved remarkably in the balance of three colors of cyan, magenta, and yellow due to fading.

The present invention will be described in more detail in accordance with the following Examples, but the invention is not limited to these Examples.

EXAMPLE 1

A multilayer photographic material (Sample 101) having layer compositions shown below was prepared by coating various photographic constituting layers on a paper support laminated on both sides thereof with polyethylene film, followed by subjecting to a corona discharge treatment on the surface thereof, and provided with a gelatin prime coat layer containing sodium dodecylbenzene-sulfonate. Coating solutions were prepared as follows:

Preparation of the Fifth Layer Coating Solution

To a mixture of 17.0 g of cyan coupler (ExC-1), 15.0 g of cyan coupler (ExC-2), 3.0 g of image-dye stabilizer (Cpd-2), 40.0 g of image-dye stabilizer (Cpd-7), 2.0 g of image-dye stabilizer (Cpd-4), 18.0 g of image-dye stabilizer (Cpd-6), and 5.0 g of image-dye stabilizer (Cpd-8) were added and dissolved 50.0 ml of ethyl acetate and each 14.0 g of solvent (Solv-6). The resulting solution was dispersed and emulsified in 500 ml of 20% aqueous gelatin solution containing 8 ml of sodium dodecylbenzenesulfonate, thereby prepared emulsified dispersion. Separately silver chlorobromide emulsion (cubic grains, 1:4 (silver molar ratio) blend of grains having 0.58 μm and 0.45 μm of average grain size, and 0.09 and 0.11 of deviation coefficient of grain size distribution, respectively, each in which 0.6 mol. % of silver bromide was located at the surface of grains) was prepared. Red-sensitive sensitizing dye E, shown below, was added in this emulsion in such amount of $0.9\times10^{-4}$ mol to the large size emulsion and $1.1\times10^{-4}$ mol to the small size emulsion, per mol of silver, respectively. The chemical ripening was carried out by adding sulfur and gold sensitizing agents. The above-described emulsified dispersion and this red-sensitive emulsion were mixed together and dissolved to give the composition shown below, thereby preparing the fifth layer coating solution. Coating solutions for the first to fourth layer, sixth layer, and seventh layer were also prepared in the same manner as the fifth layer coating solution. As a gelatin hardener for the respective layers, 1-hydroxy-3,5-dichloro-s-triazine sodium salt was used.

Further, Cpd-10 and Cpd-11 were added in each layer in such amounts that the respective total amount becomes 25.0 mg/m² and 50 mg/m².

As spectral-sensitizing dyes for the respective layers, the following compounds were used:

Sensitizing dye A for blue-sensitive emulsion layer

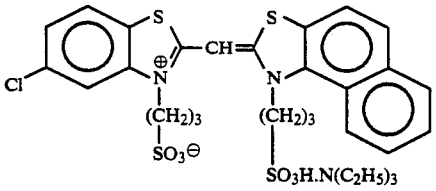

Sensitizing dye B for blue-sensitive emulsion layer

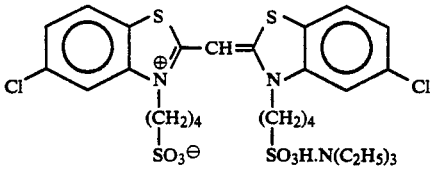

(each $2.0\times10^{-4}$ mol to the large size emulsion and $2.5\times10^{-4}$ mol to the small size emulsion, per mol of silver halide.)

Sensitizing dye C for green-sensitive emulsion layer

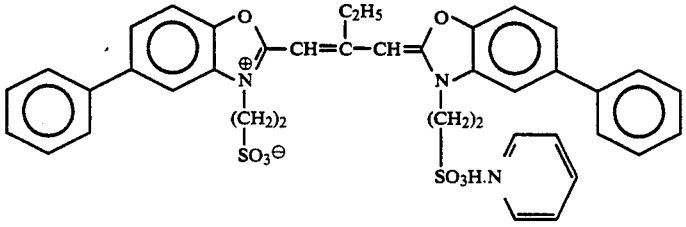

($4.0\times10^{-4}$ mol to the large size emulsion and $5.6\times10^{-4}$ mol to the small size emulsion, per mol of -continued silver halide)

Sensitizing dye D for green-sensitive emulsion layer

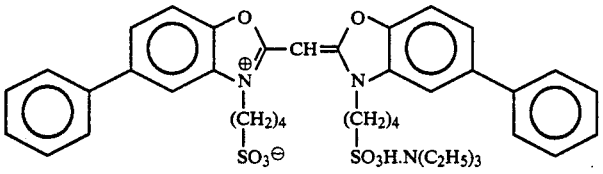

($7.0 \times 10^{-5}$ mol to the large size emulsion and $1.0 \times 10^{-5}$ mol to the small size emulsion, per mol of silver halide)

Sensitizing dye E for red-sensitive emulsion layer

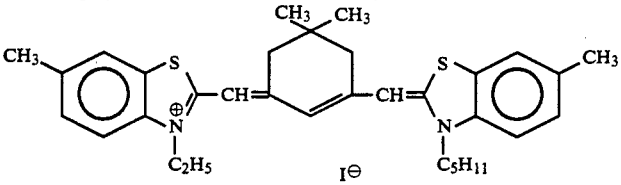

($0.9 \times 10^{-4}$ mol to the large size emulsion and $1.1 \times 10^{-4}$ mol to the small size emulsion, per mol of silver halide)

To the red-sensitive emulsion layer, the following compound was added in an amount of $2.6 \times 10^{-3}$ mol per mol of silver halide:

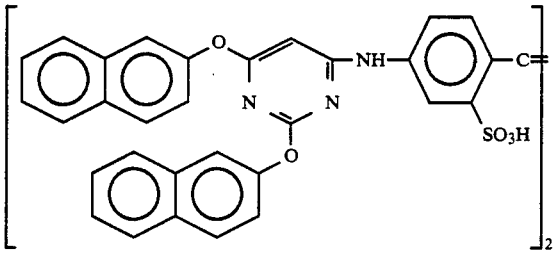

Further, 1-(5-methylureidophenyl)-5-mercaptotetrazole was added to the blue-sensitive emulsion layer, the green-sensitive emulsion layer, and the red-sensitive emulsion layer in amount of $8.5 \times 10^{-5}$ mol, $7.0 \times 10^{-4}$ mol, and $2.5 \times 10^{-4}$ mol, per mol of silver halide, respectively.

Further, 4-hydroxy-6-methyl-1,3,3a,7-tetrazaindene was added to the blue-sensitive emulsion layer and the green-sensitive emulsion layer in amount of $1 \times 10^{-4}$ mol and $2 \times 10^{-4}$ mol, per mol of silver halide, respectively.

The dyes shown below (figure in parentheses represents coating amount) were added to the emulsion layers for prevention of irradiation.

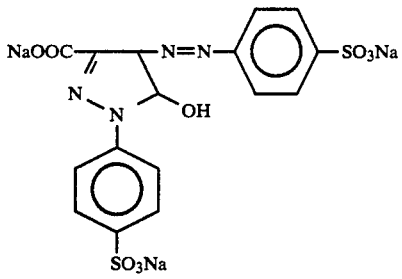

(10 mg/m²)

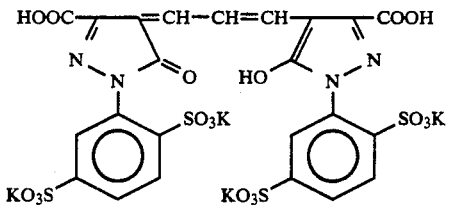

(10 mg/m²)

-continued

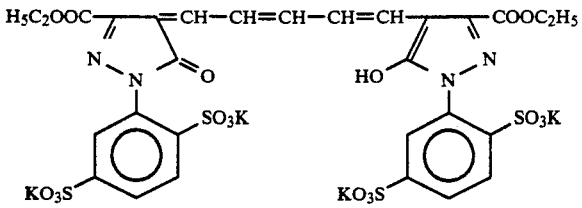

(40 mg/m²)

and

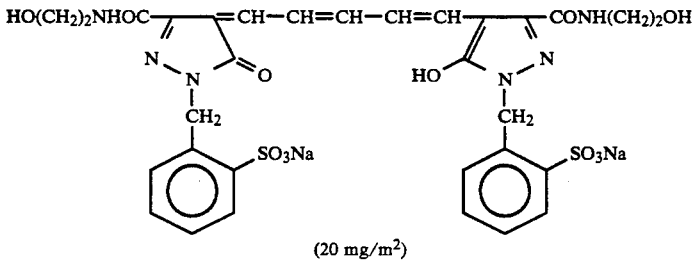

(20 mg/m²)

Composition of Layers

The composition of each layer is shown below. The figures represent coating amount (g/m²). The coating amount of each silver halide emulsion is given in terms of silver.

| | |
|---|---|
| Supporting Base | |
| Paper laminated on both sides with polyethylene (a white pigment, $TiO_2$, and a bluish dye, ultramarine, were included in the first layer side of the polyethylene-laminated film) | |
| First Layer (Blue-sensitive emulsion layer) | |
| Silver chlorobromide emulsion (cubic grains, 3:7 (Ag mol ratio) blend of large size emulsion having average grain size of 0.88 μm and small size emulsion having average grain size of 0.70 μm, each of whose deviation coefficient of grain size distribution is 0.08 and 0.10, respectively, each in which 0.3 mol % of AgBr was located at the surface of grains) | 0.28 |
| Gelatin | 2.33 |
| Yellow coupler (ExY-1) | 0.44 |
| Yellow coupler (ExY-2) | 0.38 |
| Image-dye stabilizer (Cpd-1) | 0.19 |
| Solvent (Solv-3) | 0.36 |
| Solvent (Solv-7) | 0.36 |
| Image-dye stabilizer (Cpd-7) | 0.06 |
| Second Layer (Color-mix preventing layer) | |
| Gelatin | 1.00 |
| Color-mix inhibitor (Cpd-5) | 0.08 |
| Solvent (Solv-1) | 0.16 |
| Solvent (Solv-4) | 0.08 |
| Third Layer (Green-sensitive emulsion layer) | |
| Silver chlorobromide emulsions (cubic grains, 1:3 (Ag mol ratio) blend of large size emulsion having average grain size of 0.55 μm and small size emulsion having average grain size of 0.39 μm, each of whose deviation coefficient of grain size distribution is 0.10 and 0.08, respectively, each in which 0.8 mol % of AgBr was located at the surface of grains) | 0.12 |
| Gelatin | 1.24 |
| Magenta coupler (ExM) | 0.23 |
| Imange-dye stabilizer (Cpd-2) | 0.03 |
| Image-dye stabilizer (Cpd-3) | 0.16 |
| Image-dye stabilizer (Cpd-4) | 0.02 |
| Image-dye stabilizer (Cpd-9) | 0.02 |
| Solvent (Solv-2) | 0.40 |
| Fourth Layer (Color-mix preventing layer) | |
| Gelatin | 1.58 |
| Ultraviolet-absorber (UV-1) | 0.47 |
| Color-mix inhibitor (Cpd-5) | 0.05 |
| Solvent (Solv-5) | 0.24 |
| Fifth Layer (Red-sensitive emulsion layer) | |
| Silver chlorobromide emulsions (cubic grains, 1:4 (Ag mol ratio) blend of large size emulsion having average grain size of 0.58 μm and small size emulsion having average grain size of 0.45 μm, each of whose deviation coefficient of grain size distribution is 0.09 and 0.11, respectively, each in which 0.6 mol % of AgBr was located at the surface of grains) | 0.23 |
| Gelatin | 1.33 |
| Cyan coupler (ExC-1) | 0.17 |
| Cyan coupler (ExC-2) | 0.15 |
| Image-dye stabilizer (Cpd-2) | 0.03 |
| Image-dye stabilizer (Cpd-4) | 0.02 |
| Image-dye stabilizer (Cpd-6) | 0.18 |
| Image-dye stabilzer (Cpd-7) | 0.40 |
| Image-dye stabilizer (Cpd-8) | 0.05 |
| Solvent (Solv-3) | 0.30 |
| Sixth layer (Ultraviolet ray absorbing layer) | |
| Gelatin | 0.55 |
| Ultraviolet absorber (UV-1) | 0.16 |
| Color-mix inhibitor (Cpd-5) | 0.02 |
| Solvent (Solv-5) | 0.08 |
| Seventh layer (Protective layer) | |
| Gelatin | 1.50 |
| Acryl-modified copolymer of polyvinyl alcohol (modification degree: 17% | 0.17 |
| Liquid paraffin | 0.03 |

Compounds used are as follows:

(ExY-1) Yellow coupler

-continued
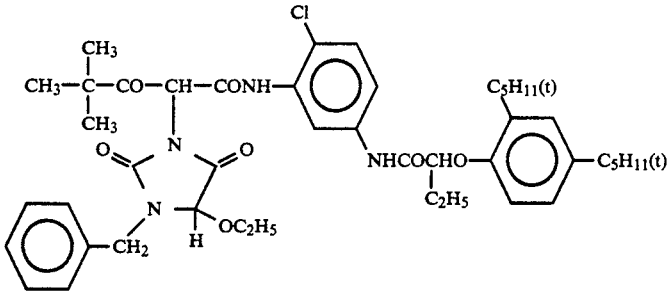
(ExY-2) Yellow coupler
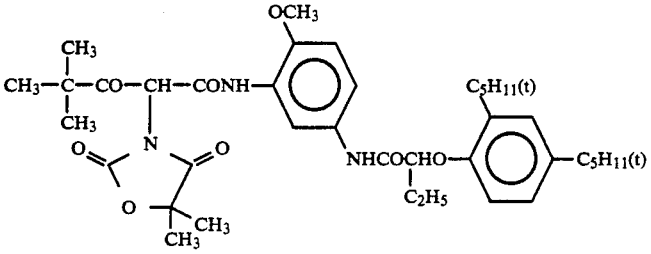
(ExM) Magenta coupler
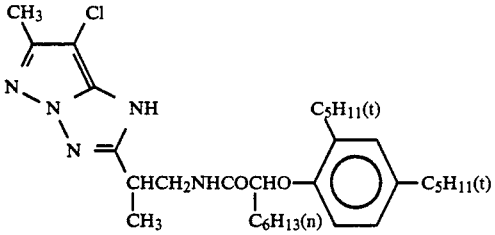
(ExC-1) Cyan coupler
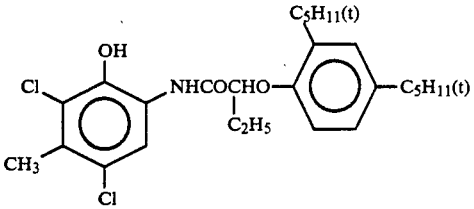
(ExC-2) Cyan coupler
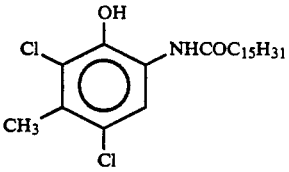
(Cpd-1) Image-dye stabilizer
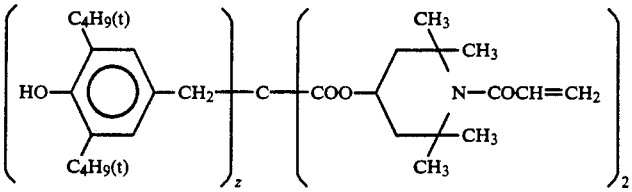
(Cpd-2) Image-dye stabilizer -continued
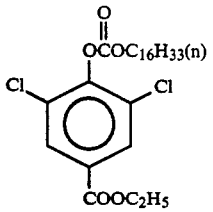
(Cpd-3) Image-dye stabilizer
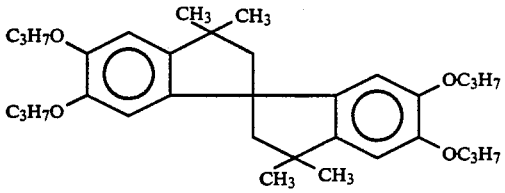
(Cpd-4) Image-dye stabilizer
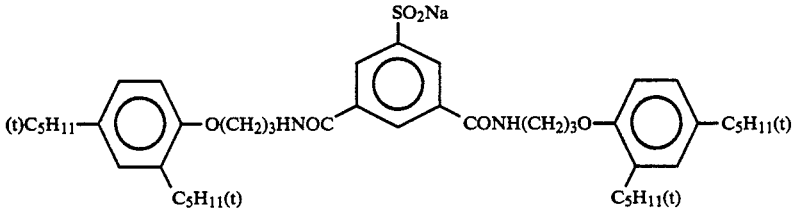
(Cpd-5) Color-mix inhibitor
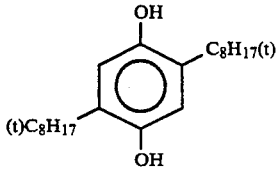
(Cpd-6) Image-dye stabilizer
Mixture (2:4:4 in weight ratio) of
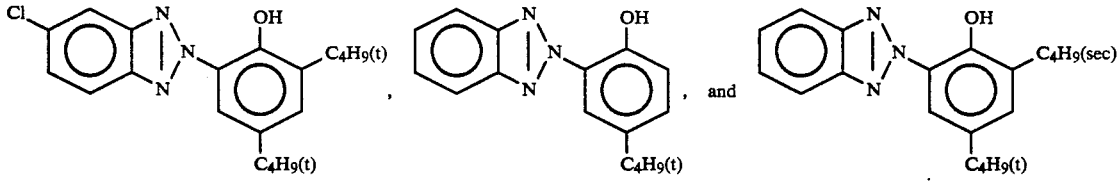
(Cpd-7) Image-dye stabilizer
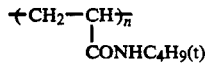
Average molecular weight: 60,000
(Cpd-8) Image-dye stabilizer
Mixture (1:1 in weight ratio) of
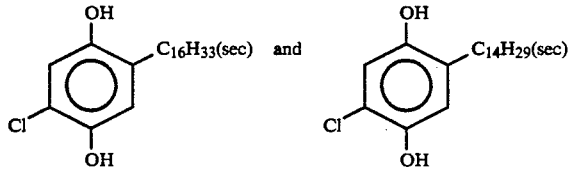
(Cpd-9) Image-dye stabilizer -continued
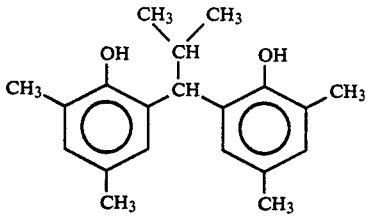
(Cpd-10) Antiseptic
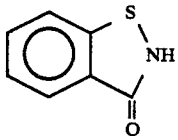
(Cpd-11) Antiseptic
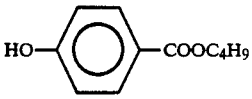
(UV-1) Ultraviolet ray absorber
Mixture (4:2:4 in weight ratio) of
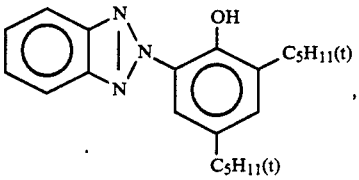
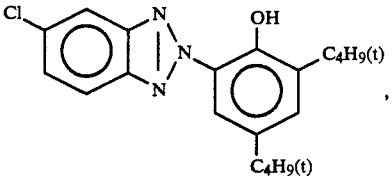
and
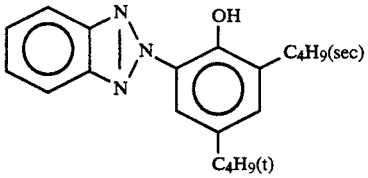
(Solv-1) Solvent
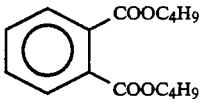
(Solv-2) Solvent
Mixture (1:1 in volume ratio) of
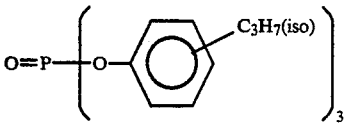
and
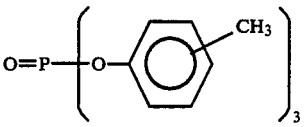
(Solv-3) Solvent
$O{=}P{+}O{-}C_9H_{19}(iso)]_3$
(Solv-4) Solvent
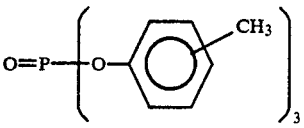
(Solv-5) Solvent -continued

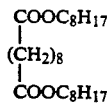

(Solv-6) Solvent
Mixture (80:20 in volume ratio) of

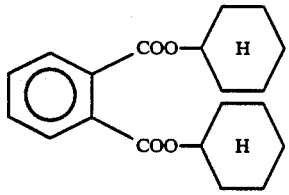

and $C_8H_{17}CHCH(CH_2)_7COOC_8H_{17}$ (O)

(Solv-7) Solvent
$C_8H_{17}CHCH(CH_2)_7COOC_8H_{17}$ (O)

Samples 102 to 112 were prepared in the same manner as Sample 101, except that the yellow coupler in the first layer and the cyan coupler in the fifth layer were changed with equimolar amount of couplers as shown in Table 1.

Then, each of samples was subjected to a gradation exposure to light through a three color separated filter for sensitometry using a sensitometer (FWH model made by Fuji Photo Film Co., Ltd., the color temperature of light source was 3200° K.). At that time, the exposure was carried out in such a manner that the exposure amount was 250 CMS with the exposure time being 0.1 sec.

After exposure to light, each sample was subjected to a running test according to the processing step shown below by using a paper processor, until the replenishing volume reached to twice the volume of color developer tank.

| Processing step | Temperature | Time | Replenisher* | Tank Volume |
|---|---|---|---|---|
| Color developing | 35° C. | 45 sec | 161 ml | 17 liter |
| Bleach-fixing | 30–35° C. | 45 sec | 215 ml | 17 liter |
| Rinse (1) | 30–35° C. | 20 sec | — | 10 liter |
| Rinse (2) | 30–35° C. | 20 sec | — | 10 liter |
| Rinse (3) | 30–35° C. | 20 sec | 350 ml | 10 liter |
| Drying | 70–80° C. | 60 sec | | |

Note:
*Replenisher amount per $m^2$ of photographic material.
Rinsing steps were carried out in 3-tanks countercurrent mode from the tank of rinsing (3) toward the tank of rinsing (1).

The composition of each processing solution is as follows, respectively:

| Color-developer | Tank Solution | Replenisher |
|---|---|---|
| Water | 800 ml | 800 ml |
| Ethylenediamine-N,N,N',N'-tetramethylene phosphonic acid | 1.5 g | 2.0 g |
| Potassium bromide | 0.015 g | — |
| Triethanolamine | 8.0 g | 12.0 g |
| Sodium chloride | 1.4 g | — |
| Potassium carbonate | 25 g | 25 g |
| N-ethyl-N-(β-methanesulfonamidoethyl)-3-methyl-4-aminoaniline sulfate | 5.0 g | 7.0 g |
| N,N-Bis(carboxymethyl)hydrazine | 4.0 g | 5.0 g |
| Monosodium N,N-di(sulfoethyl)-hydroxylamine | 4.0 g | 5.0 g |
| Fluorescent whitening agent (WHITEX-4B, made by Sumitomo Chemical Ind.) | 1.0 g | 2.0 g |
| Water to make | 1000 ml | 1000 ml |
| pH (25° C.) | 10.05 | 10.45 |

-continued

| Bleach-fixing solution (Both tank solution and replenisher) | |
|---|---|
| Water | 400 ml |
| Ammonium thiosulfate (70 g/l) | 100 ml |
| Sodium sulfite | 17 g |
| Iron (III) ammonium ethylenediaminetetraacetate dihydrate | 55 g |
| Disodium ethylenediaminetetraacetate | 5 g |
| Ammonium bromide | 40 g |
| Water to make | 1000 ml |
| pH (25°) | 6.0 |

| Rinse solution (Both tank solution and replenisher) |
|---|
| Ion-exchanged water (calcium and magnesium each are 3 ppm or below) |

Thus processed samples are referred to as Group A.

Samples of Group A were immersed into N-2 processing solution of CN-16 made by Fuji Photo Film Co., Ltd. at 38° C. for 5 minutes, and then they were washed in flowing water for 10 minutes and were dried, thereby cyan color-formed samples were obtained. These samples were referred to as Group B.

Evaluations for cyan color formation and fading properties of yellow and cyan were carried out by the following procedures using samples of Group A and Group B:

(1) Evaluation of cyan color formation

Maximum cyan color density of each sample of Group A (DmaxA) and maximum cyan color density of each sample of Group B (DmaxB) were determined, and the cyan color formation was evaluated by the following formula:

$$\text{Cyan color formation (\%)} = (\text{DmaxA}/\text{DmaxB}) \times 100$$

It means that the near the value to 100%, the better the cyan color formation is.

(2) Evaluation of heat-and-humidity fading

Each sample of Group B was allowed to stand for six months in a dark place at 60° C. and 70% relative humidity, and respective residual dye amounts in percentage were calculated by determining the decrease of density at the initial density of 1.5 of cyan, magenta, and yellow.

Results are shown in Table 1.

TABLE 1

| Sample No. | Yellow coupler in the 1st layer | | Cyan coupler in the 5th layer | | Cyan color formation (%) | Residual dye amount (%) after heat and humidity fading | | | Remarks |
|---|---|---|---|---|---|---|---|---|---|
| | | | | | | Cyan | Magenta | Yellow | |
| 101 | ExY-1 | ExY-2 | ExC-1 | ExC-2 | 75 | 70 | 98 | 78 | Comparative Example |
| 102 | Y-1 | ExY-2 | ExC-1 | ExY-2 | 79 | 70 | 98 | 92 | " |
| 103 | ExY-1 | ExY-2 | ExC-1 | C-5 | 78 | 90 | 98 | 79 | " |
| 104 | Y-1 | ExY-2 | ExC-1 | C-5 | 90 | 93 | 98 | 93 | This invention |
| 105 | Y-6 | Y-6 | C-3 | ExC-2 | 92 | 92 | 97 | 95 | " |
| 106 | Y-13 | Y-13 | C-3 | ExC-2 | 91 | 92 | 98 | 98 | " |
| 107 | Y-15 | Y-15 | C-3 | ExC-2 | 92 | 93 | 98 | 96 | " |
| 108 | Y-31 | Y-31 | C-3 | ExC-2 | 93 | 91 | 97 | 96 | " |
| 109 | Y-6 | Y-6 | C-1 | C-5 | 95 | 95 | 98 | 94 | " |
| 110 | Y-6 | Y-6 | C-3 | C-6 | 94 | 93 | 98 | 96 | " |
| 111 | Y-6 | Y-54 | C-3 | ExC-2 | 86 | 89 | 98 | 90 | " |
| 112 | Y-55 | Y-55 | C-3 | ExC-2 | 85 | 87 | 98 | 88 | " |

As is apparent from the results in Table 1, the photographic material utilizing yellow coupler and cyan coupler of the present invention is excellent in cyan color formation, and the fading of cyan and yellow is remarkably improved, resulting in that the three color balance of cyan is remarkably improved.

Having described our invention as related to the present embodiments, it is our intention that the invention not be limited by any of the details of the description, unless otherwise specified, but rather be construed broadly within its spirit and scope as set out in the accompanying claims.

What we claim is:

1. A silver halide color photographic material having on a base at least one cyan color-forming silver halide emulsion layer, at least one magenta color-forming silver halide emulsion layer, and at least one yellow color-forming silver halide emulsion layer, which comprises, in said yellow color forming silver halide emulsion layer, at least one nondiffusible yellow coupler represented by the following formulas (1) or (2), and, in said cyan color forming silver halide emulsion layer, at least one cyan coupler represented by the following formula (C):

Formula (1)

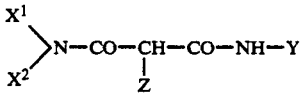

Formula (2)

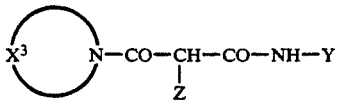

wherein $X^1$ and $X^2$ each represent an alkyl group, an aryl group, or a heterocyclic group, $X^3$ represents an organic residue required to form a nitrogen-containing heterocyclic group together with >N—, Y represents an aryl group or a heterocyclic group, and Z represents a group capable of being released upon a coupling reaction of the coupler represented by said formula with the oxidized product of a developing agent, Formula (C)

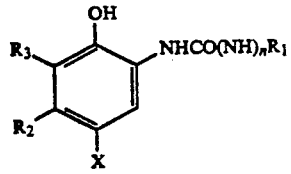

wherein $R_1$ represents an alkyl group, an aryl group, or a heterocyclyc group, $R_2$ represents an alkyl group having 2 or more carbon atoms, $R_3$ represents a hydrogen atom, a halogen atom, an alkyl group, an aryl group, an alkoxy group, an aryloxy group, a carbonamido group, or a ureido group, X represents a hydrogen atom or a group capable of being released upon a coupling reaction of the coupler represented by said formula with the oxidized product of a developing agent, and n is an integer of 0 or 1.

2. The silver halide color photographic material as claimed in claim 1, wherein the nondiffusible yellow coupler represented by formulas ( 1 ) or ( 2 ) is selected from the group consisting of compounds represented by the following formulas (3), (4), or (5):

Formula (3)

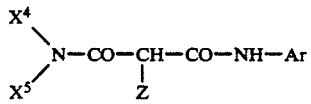

Formula (4)

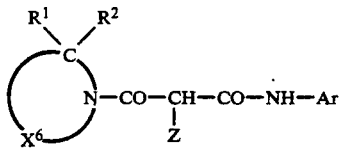

Formula (5)

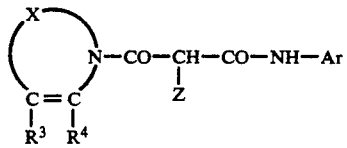

wherein Z represents a group capable of being released upon a coupling reaction of the coupler represented by formulas (3), (4), or (5) with the oxidized product of a developing agent, $X^4$ represents an alkyl group, $X^5$ represents an alkyl group or an aromatic group, Ar represents a phenyl group having at least one substituent in the ortho position, $X^6$ represents an organic residue required to form a nitrogen-containing cyclic group together with —C($R^1R^2$)—N<, $X^7$ represents an organic residue required to form a nitrogen-containing heterocyclic group together with —C($R^3$)=C($R^4$)—N<, and $R^1$, $R^2$, $R^3$, and $R^4$ each represent a hydrogen atom or a substituent.

3. The silver halide color photographic material as claimed in claim 1, wherein $X^1$ or $X^2$ in formula (1) is an alkyl group having 1 to 10 carbon atoms.

4. The silver halide color photographic material as claimed in claim 1, wherein Y in formula (1) or (2) represents an aromatic group.

5. The silver halide color photographic material as claimed in claim 4, wherein the aromatic group is a phenyl group having at least one substituent in the ortho position.

6. The silver halide color photographic material as claimed in claim 1, wherein Z in formulae (1) and (2) is a 5- to 6-membered nitrogen-containing heterocyclic group bonded to the coupling site through the nitrogen atom, an aromatic oxy group, a 5- to 6-membered heterocyclic oxy group, or a 5- to 6-membered heterocyclic thio group.

7. The silver halide color photographic material as claimed in claim 1, wherein the coupler represented by formulas (1) or (2) forms a dimer or higher polymer by bonding at the groups represented by $X^1$ to $X^3$, Y, and Z through a divalent group or higher polyvalent group.

8. The silver halide color photographic material as claimed in claim 2, wherein the coupler represented by formulas (3), (4), or (5) forms a dimer or higher polymer by bonding at the groups represented by $X^4$ to $X^7$, Ar $R^1$ to $R^4$, and Z through a divalent group or higher polyvalent group.

9. The silver halide color photographic material as claimed in claim 1, wherein the coating amount of coupler represented by formulas (1) or (2) in a silver halide emulsion layer is in the range of 0.1 to 1.0 mmol per $m^2$ of the photographic material.

10. The silver halide color photographic material as claimed in claim 1, wherein $R_1$ in formula (C) represents an alkyl group.

11. The silver halide color photographic material as claimed in claim 1, wherein $R_2$ in formula (C) represents an alkyl group having 2 to 36 carbon atoms.

12. The silver halide color photographic material as claimed in claim 1, wherein $R_3$ in formula (C) represents a halogen atom.

13. The silver halide color photographic material as claimed in claim 1, wherein X in formula (C) represents a hydrogen atom, a fluorine atom, a chlorine atom, a sulfo group, an alkoxy group, or an aryloxy group.

14. The silver halide color photographic material as claimed in claim 1, wherein the coating amount of coupler represented by formula (C) in a silver halide emulsion layer is in the range of 0.1 to 1.0 mmol per $m^2$ of the photographic material.

15. The silver halide color photographic material as claimed in claim 1, wherein the silver halide emulsion of said silver halide color photographic material comprises a silver chlorobromide or silver chloride having a silver chloride content of 90 mol. % or more and substantially no silver iodide content.

16. The silver halide color photographic material as claimed in claim 1, wherein Z in formulas (1) and (2) is a nonphotographically useful group.

17. The silver halide color photographic material as claimed in claim 2, wherein Z in formulas (3), (4) and (5) is a nonphotographically useful group.

18. The silver halide color photographic material as claimed in claim 1, wherein Z in formulas (1) and (2) is a 5- to 6-membered nitrogen-containing heterocyclic group bonded to the coupling site through the nitrogen atom, or a 5- to 6-membered heterocyclic thio group.

* * * * *